United States Patent [19]

Frost et al.

[11] Patent Number: 4,900,297

[45] **Date of Patent: * Feb. 13, 1990**

[54] DOWNSTACKER ASSEMBLY WITH OFFLOADING STACKER

[75] Inventors: Terry Frost, Rockford, Wash.; Terry B. Smith, Coeur d'Alene, Id.; Jennings A. Jones, Mead, Wash.

[73] Assignee: ASC Machine Tools, Inc., Spokane, Wash.

[ * ] Notice: The portion of the term of this patent subsequent to Apr. 26, 2005 has been disclaimed.

[21] Appl. No.: 185,760

[22] Filed: Apr. 25, 1988

Related U.S. Application Data

[63] Continuation-in-part of Ser. No. 909,557, Sep. 19, 1986, Pat. No. 4,740,193.

[51] Int. Cl.[4] ..... B31B 1/14

[52] U.S. Cl. ..... 493/82; 493/342; 414/36; 414/73; 271/183; 271/197; 271/224; 271/218

[58] Field of Search ..... 271/218, 217, 224, 183, 271/197; 493/342, 82, 83, 373, 13, 14; 53/228; 83/101, 102, 103; 414/36, 73; 225/97

[56] References Cited

U.S. PATENT DOCUMENTS

| | | | |
|---|---|---|---|
| 2,205,767 | 6/1940 | Lamb | 271/88 |
| 2,895,552 | 7/1959 | Pomper et al. | 164/68 |
| 3,022,999 | 2/1962 | Mead | 271/68 |
| 3,263,827 | 8/1966 | Verriender | 214/6 |
| 3,270,929 | 9/1966 | Foster | 225/97 |
| 3,307,326 | 3/1967 | Krebs | 53/228 |
| 3,362,707 | 1/1968 | Lauren | 271/88 |
| 3,463,485 | 8/1969 | Atwood | 414/36 |
| 3,477,711 | 11/1969 | Lyman | 271/74 |
| 3,698,708 | 10/1972 | Brawn | 271/74 |
| 3,765,993 | 10/1973 | Rattensparger et al. | 414/36 |
| 3,820,779 | 6/1974 | Bishop | 271/180 |
| 3,892,168 | 7/1975 | Grobman . | |
| 4,027,873 | 6/1977 | Bishop | 271/197 |
| 4,083,275 | 4/1978 | Lingl | 83/102 |
| 4,130,207 | 12/1978 | Cogswell | 414/36 |
| 4,295,842 | 10/1981 | Bell | 493/342 |
| 4,324,522 | 4/1982 | Buccicone | 414/51 |
| 4,474,565 | 10/1984 | Watson et al. | 493/342 |
| 4,494,745 | 1/1985 | Ward, Sr. et al. | 271/95 |
| 4,500,243 | 2/1985 | Ward, Jr. et al. | 414/50 |
| 4,500,244 | 2/1985 | Sardella et al. | 414/92 |

FOREIGN PATENT DOCUMENTS 2062370 6/1972 Fed. Rep. of Germany .

*Primary Examiner*—D. S. Meislin
*Assistant Examiner*—Jack W. Lavinder
*Attorney, Agent, or Firm*—Bill D. McCarthy

[57] ABSTRACT

A downstacker assembly in which paperboard blanks, received from a die cutter station, are passed sequentially through a trim removal station, a feed station, a stacker assembly partially disposed in a pit, and a stack retrieval assembly. The stacker assembly is disposed in a drop chute beneath a vacuum conveyor assembly which drops the blanks from the feed station into the drop chute, assisted by a pair of twin blank striker assemblies which selectively separate the blank therefrom. The stacking blanks are tamped using a semiflexible tamper plate assembly against flexible curtains on a descending elevator assembly. A stack staging assembly serves as a temporary cradle to catch the falling blanks once a predetermined stack height is achieved until the stacks can be removed via the stack retrieval assembly. A dunnage holding assembly provides multiple-tier load forming as the stacks are discharged from the downstacker assembly.

18 Claims, 11 Drawing Sheets

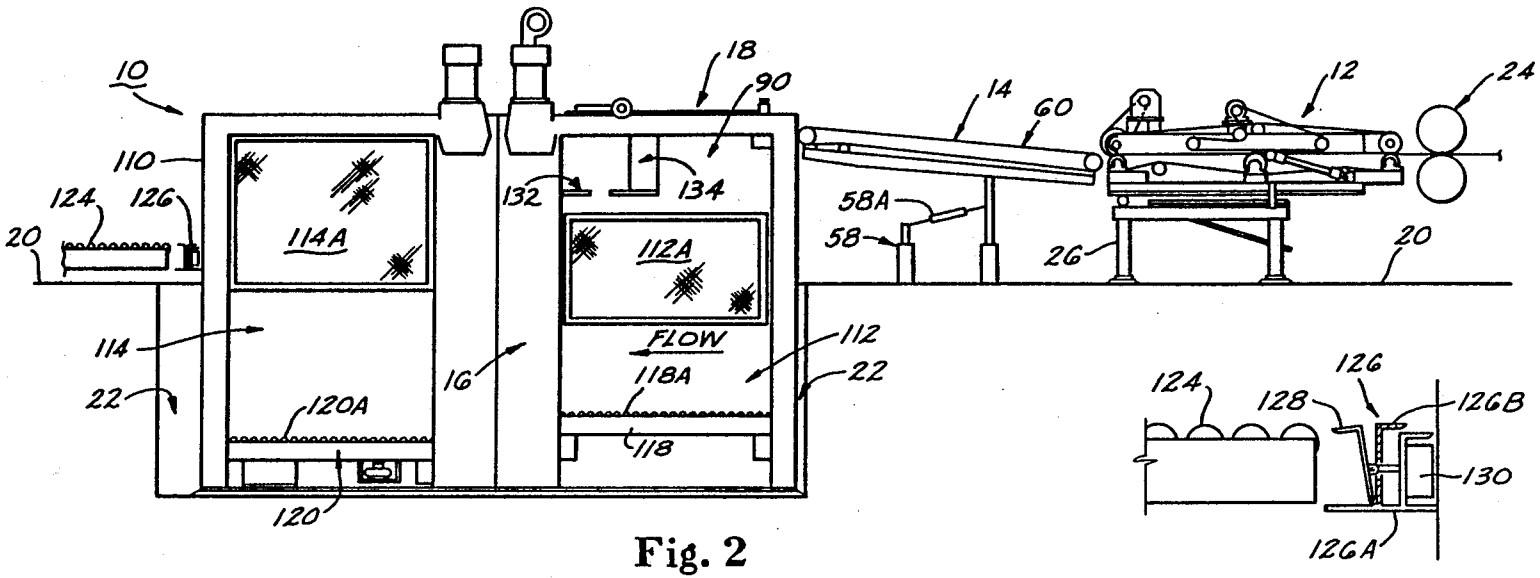
Fig. 2
Fig. 17
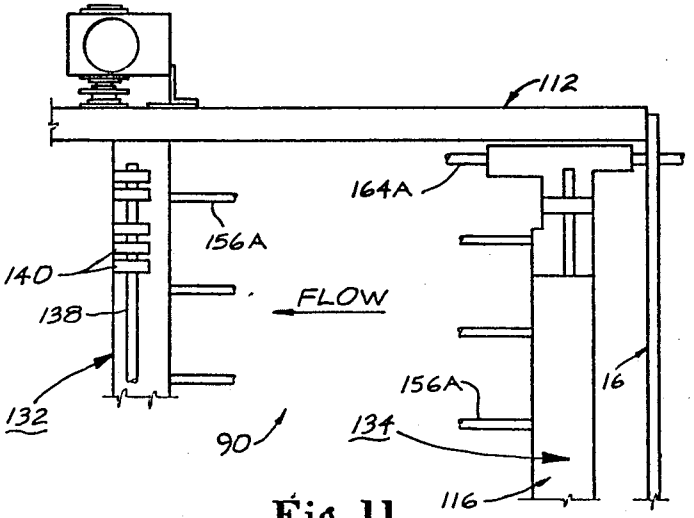
Fig. 11
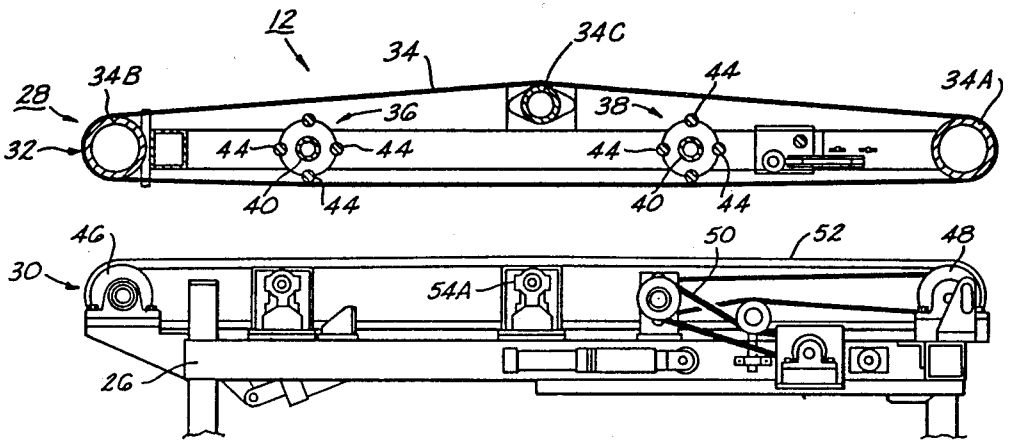
Fig. 3

DOWNSTACKER ASSEMBLY WITH OFFLOADING STACKERCROSS REFERENCE TO RELATED APPLICATION

This is a continuation-in-part application to U.S. patent application entitled DOWNSTACKER ASSEMBLY, Ser. No. 909,557, filed September 19, 1986 and now U.S. Pat. No. 4,740,193.

BACKGROUND OF INVENTION

1. Field of the Invention

The present invention relates generally to the field of material handling equipment, and more particularly but not by way of limitation, to an improved downstacker assembly for stacking paperboard products at high speeds and for forming multiple-tier loads of stacks.

2. Discussion of Prior Art

The packaging of products in paperboard containers or boxes has increased so much over the years that a very large packing industry has emerged. It is common to cut paperboard container blanks from planar sheets of corrugated composition via rotating dies that operate at very great linear speeds. The blanks are then removed of excess trim and stacked flat in bundles for shipment to points of usage.

The work function which is addressed by the present invention is that of receiving, detrimming and stacking paperboard flats or blanks from the aforementioned rotary die cutters. The linear exit speeds of these paperboard blanks can approach hundreds of feet per minute, with up to one thousand feet per minute and more being possible if the rotary die capability speeds are matched. Unfortunately, no prior art stackers have been capable of reaching and maintaining such capability.

Interestingly, the stacking function has long been addressed, such as by the continuous layboy taught by Lamb in U.S. Pat. No. 2,205,767 (issued June 25, 1940), who even then recognized that much had been accomplished in the mechanization of stacking. In essence, Lamb presented a main receiving table which was lowered at the rate of stack build up, and a finger table which was capable of moving into position to temporarily catch the falling blanks while unloading the main table.

Ward and West, in a more recent and perhaps more complete teaching in U.S. Pat. No. 4,500,243 (issued Feb. 19, 1985), taught a blank stacking apparatus utilizing the feature of receiving the paperboard blanks onto an inclined vacuum conveyor to deliver same to the lower run of an overhead vacuum conveyor disposed over a dropping chute. Release of the blanks is achieved by timing the interruption of vacuum suction to the belts (by the supporting pulleys) just over the dropping area. As the falling blanks settle upon an underlying conveyor, the conveyor is withdrawn downwardly as the stack builds. Side spanker assemblies tamp the stack to align it. Once a stack is completed, a set of tines is extended to catch the blanks during unloading of the stack. The disadvantage of the Ward and West downstacker is the difficulty in maintaining the timing sequence required thereby at high operating speeds.

None of the prior art stackers known to the present inventors achieves continuous, high speed stacking of paperboard blanks and the like. It is to that end to which the present invention is directed.

SUMMARY OF INVENTION

The present invention provides an improved downstacker assembly uilized for receiving and stacking paperboard blanks from a die cutter assembly. Rows of blanks are sequentially passed to a vacuum conveyor assembly which holds and advances the blanks to a position over a dropping chute. An impacting assembly stops the forward advancement of the blanks at the position over the drop chute, and the blanks are caused to fall into the drop chute.

A stacking assembly which is disposed in the drop chute beneath the vacuum conveyor assembly receives the falling blanks to form adjacently disposed stacks of blanks.

The impacting assembly is further characterized as having a pair of blank striker assemblies which knock the blanks away from the vacuum conveyor assembly.

The stacking assembly is characterized as having a platform assembly disposed at least partially in a pit beneath the falling blanks, and a tamper assembly which tamps the side edges of the blanks as the stacks are forming to provide substantially uniform sides to the stacks. Flexible curtains are provided to hang between adjacent stacks being formed on the platform assembly in order to provide a flexible back up between adjacently disposed stacks so that substantially no gap exists between adjacent stacks.

A stack retrieval assembly is provided for receiving the blank stacks from the platform assembly after the platform assembly is lowered in the pit and for elevating the blank stacks to be discharged onto a receiving conveyor. An elevatable dunnage clamp assembly selectively secures dunnage sheets as the blank stacks are pushed onto the receiving conveyor in either single or multiple tier stacks.

The stacking assembly also comprises a stack staging assembly which is selectively disposable beneath the vacuum conveyor assembly to temporarily collect falling blanks during unloading of the already collected stacks from the platform assembly. Interrupt control of blank feeding can be employed to momentarily interrupt the passing of the blanks to the downstacker assembly to provide a gap in the passage of the blanks to the vacuum conveyor assembly during the interval when the stack staging assembly is being moved into position beneath the vacuum conveyor assembly.

A trim removal conveyor is utilized for receiving the blanks from a die cutter assembly, the trim removal conveyor comprising a sandwich conveyor assembly which has a lower rope conveyor and an upper web conveyor, and a beater assembly disposed to vibrate the upper web conveyor against the passing blanks to beat the trim free and to cause same to fall between the ropes of the lower rope conveyor.

Further, a feed station assembly having a plurality of endless conveyor belts perforated to vacuum hold and spread the blanks is utilized to move the blanks from the trim removal station to the vacuum conveyor assembly.

The primary object of the present invention is to provide a downstacker assembly capable of achieving high speed downstacking of paperboard blanks from a die cutter assembly in single or multiple tier stacks.

Another object of the present invention is to provide such a downstacker assembly which achieves the above stated object at a minimum capital investment cost and minimum maintenance requirements, and which can be operated with a minimum of operator attention.

Other objects, advantages and features of the present invention will become clear from the following description of the preferred embodiment when read in conjunction with the accompanying drawings and appended claims.

BRIEF DESCRIPTION OF DRAWINGS

FIG. 2 is a side elevational view of the downstacker assembly of FIG. 1. For clarity, the downstacker assembly is depicted in semi-detailed view in FIG. 2.

FIG. 3 is a semi-detailed, partial cutaway, side elevational view of portions of the trim removal station.

FIG. 11 is a schematic representation depicting the relative positions of the stationary backstop and the movable backstop of the downstacker station.

FIG. 17 is an enlarged detail of the dunnage clamp assembly disposed at the discharge opening of the downstacker station.

DESCRIPTION

Like numerals and characters designate like elements throughout the figures of the drawings.

Figure 1:
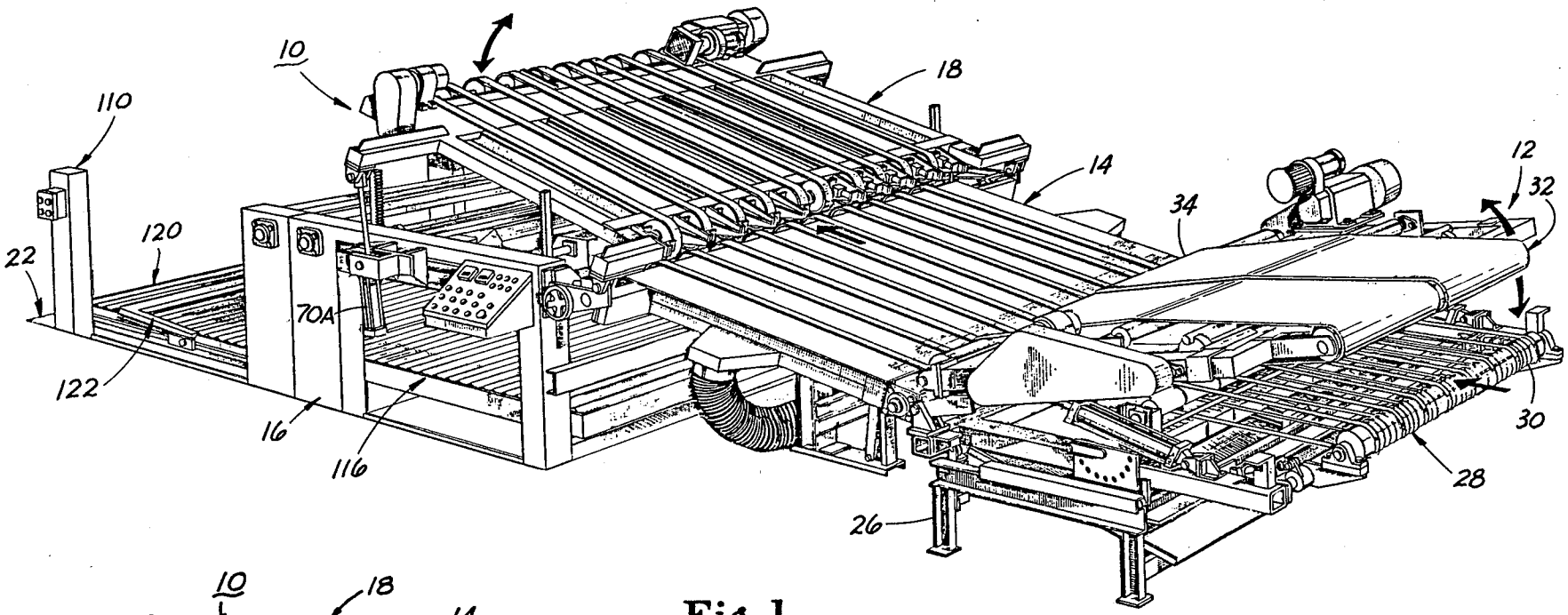
FIG. 1 is a perspective view of a downstacker assembly constructed in accordance with the present invention. For clarity, portions of the downstacker assembly are removed to disclose certain details thereof.
Figure 1A:
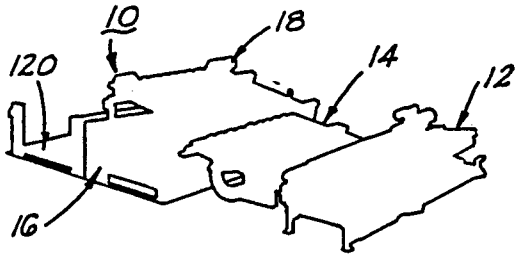
FIG. 1A is a profile schematic depicting relative locations of the major components of the downstacker assembly.

Reference is initially directed to FIG. 1 which shows in perspective view a downstacker assembly constructed in accordance with the present invention. FIG. 1A is an outline of the major stations that comprise the downstacker assembly, and this outline is provided for convenience in locating the positions of the stations. More specifically:

10 depicts the downstacker assembly.

12 is a trim removal station, and as shown, has its sandwich conveyor assembly partially open for maintenance access.

14 is a feed station.

16 is a downstacker station.

18 is a vacuum conveyor assembly portion of the downstacker station 16. As shown, the vacuum conveyor assembly 18 is partially opened as when maintenance access is afforded.

20 in FIG. 2 is a concrete floor upon which the downstacker assembly 10 is supported. As used herein, floor level elevation means the elevation of the concrete floor 20.

22 is a pit into which a portion of the downstacker station 16 is disposed.

24 depicts the profile of a rotary die cutter assembly which cuts paperboard blanks from a web or sheets of cardboard and the like.

FIG. 2 is a side elevational depiction of these assemblies showing their positional relationship to the die cutter assembly 24 which directs cut blanks with trim to the trim removal station 12. The trim removal station 12 knocks the trim from the blanks and moves the blanks onto the upper surface of the feed station 14. The feed station 14 is an inclined vacuum conveyor which does two functions: it separates the laterally adjacent blanks and an inch or so apart as the blanks are moved up an incline to the lower run of the vacuum conveyor 18.

The vacuum conveyor 18, as will be made clearer, moves the blanks to a position over a drop chute, and other mechanisms forcibly remove the blanks from the vacuum conveyor so that the blanks fall onto the progressively lowering platform conveyor disposed within the pit in the drop chute area. For the discussion which follows, the paperboard blanks are substantially flat cardboard members having forward and rear portions with leading edges and rear edges, respectively.

Figure 3A:
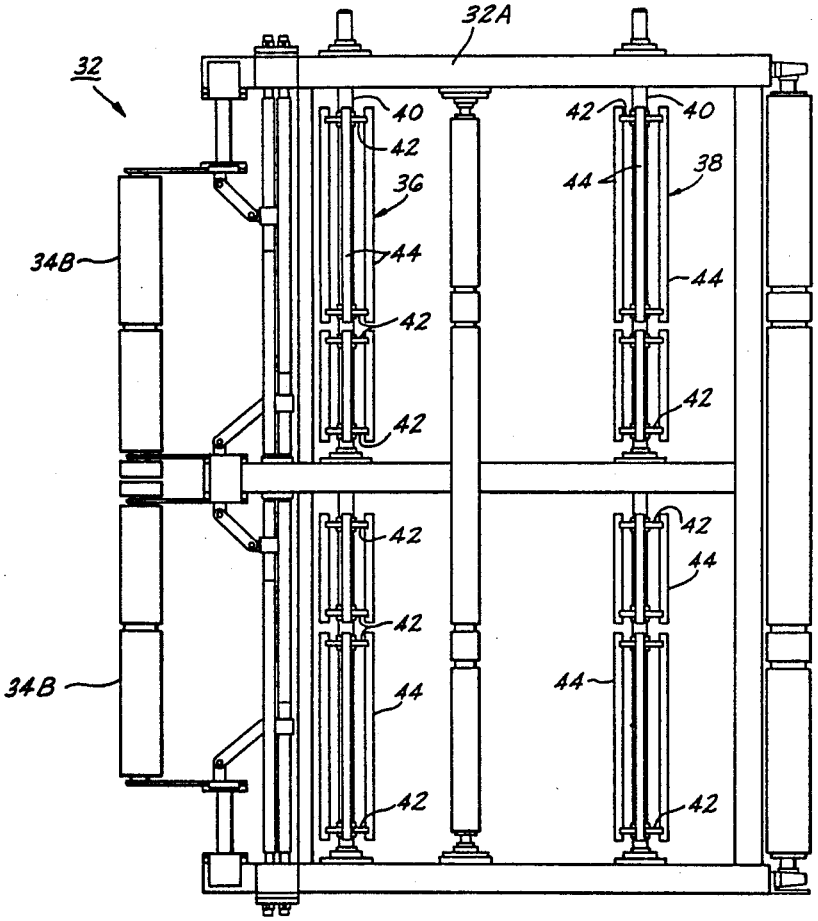
FIG. 3A is a plan view of the upper web conveyor with the belts removed therefrom.
Figure 3B:
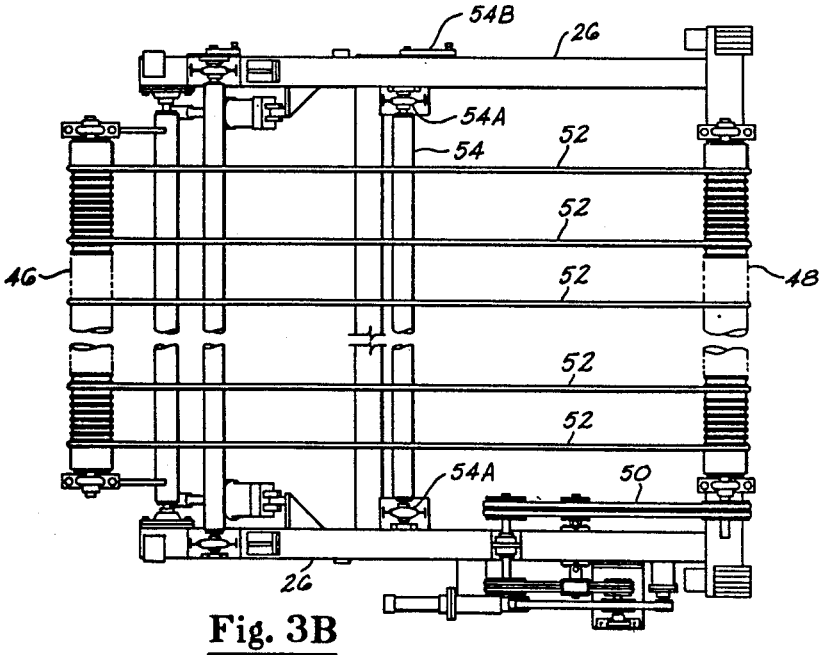
FIG. 3B is a plan view, in partial cutaway depiction, of the lower rope conveyor.

FIGS. 3, 3A and 3B show various partial views of the trim removal station 12. Many details of the trim removal station 12 are conventional and will be omitted in the interest of brevity.

26 is a lower support frame and is also viewable in part in FIG. 1.

28 is a sandwich conveyor assembly supported by the support frame 26 and is comprised of the following:

30 is a lower rope conveyor assembly;

32 is an upper web conveyor assembly portion of the sandwich conveyor assembly 28. The web conveyor assembly 32 has an upper box frame 32A which is pivotably connected to the lower support frame 26 for pivoting of the web conveyor assembly 32 to an open position by pivoting support rams (viewable in part in FIG. 1).

34 is a pair of flexible endless web belts disposed over spaced apart arbors 34A and 34B (FIG. 3A shows the upper web conveyor assembly with the web belts 34 removed in order to show details of structure). A drive arbor 34A is powered by a sheave and belt (not shown) attached outboard to this arbor. A pair of arbors 34B are coaxially mounted so as to be adjustable to accommodate and matted conventionally to adjust to the stretch length of the belts. Also, an adjustable mid arbor 34C is provided.

36 and 38 are a pair of beater members that are disposed in parallel relationship to the arbors 34A, 34B and 34C and supported by the same cross frame members. Each of the beater members is comprised of the following:

40 is a central drive shaft driven by a sheave and power belt (not shown) attached outboard thereto.

42 depicts a plurality of spaced apart spacer members supported along each of the beater members 36, 38.

44 depicts a plurality of beater bars bridging and supported by various ones of the spacer members 42.

46 and 48 are grooved arbors supported in spaced apart disposition via the lower support frame 26, as shown in FIG. 3B.

50 is a power drive assembly for the grooved arbor 48.

52 depicts a plurality of flexible, endless rope members that are disposed over the grooved arbors 46, 48. Five such rope members 52 are shown in FIG. 3B for illustration, but the number of such belts is variable and other such belts can be run in the remaining grooves shown on the arbors 46, 48. In general, the number and spacing of such rope members 52 will depend upon the package and trim profile fed from the rotary die cutter assembly 24, with the rope members 52 being disposed to support the blanks while being sufficiently spaced to permit trim droppings therebetween.

54 are adjustment arbors disposed beneath the top run of the rope members 52, each of which has a cam lift device 54A which elevates or lowers the adjustment arbor 54 upon turning of a set handle 54B.

The endless web belts 34 are preferably made of reinforced rubber or flexible plastic material having knob like protrusions in a pattern that generally makes multiple point contact against the top of the paperboard blanks and trim received from the die cutter assembly 24. FIG. 3 depicts the lower rope conveyor assembly 30 and the upper web conveyor assembly portion 32 in parallel, spaced apart disposition; this is for illustration only. In actuality, the upper web conveyor assembly portion 32 is pivotally attached at one end to the support frame 26 and is pivotable to the open position shown in FIG. 1 via appropriately disposed hydraulic rams. In the closed position, the lower runs of the web belts 34 are brought into close position to the upper runs of the rope members 52. In operation, the driven rotation of the central drive shaft 40 causes the beater members 36, 38 to beat against the web belts 34 as the beater members 36, 38 rotate and strike the belts. This creates continuous vibratory motion in the web belts 34 which is imparted to the paperboard blanks, causing the trim portions to be separated from the blanks and to be directed downwardly between the rope members 52. The intensity of this vibratory motion on the paperboad blanks can be adjusted by the adjustment arbor 54 of the lower rope conveyor assembly 30. Of course, the number and spacing of the rope members 52 on the grooved arbors 46, 48 are established to support the blanks while permitting trim removal to fall therebetween, with an appropriately positioned chute disposed therebeneath to eject collected trim to a disposition conveyor (not shown). The paperboard blanks less trim are directed via the trim removal station 12 to the feed station 14.

The feed station 14 is a spacing conveyor which moves the paperboard blanks received from the trim removal station 12 to the downstacker station 16. For operational convenience, the pit 22 is provided in order to lower the height of the downstacker station 16 for improved operator and maintenance accessibility. Also, the feed station 14 is inclined to accommodate the difference in elevation between the die cutter assembly 24 and the vacuum conveyor station 18 of the downstacker station 16, and the pit 22 minimizes this incline. The feed station 14, as shown in FIG. 2, spans the distance between the vacuum conveyor assembly 18 and the trim removal station 12, and comprises the following details of construction.

58 is a supporting framework.

60 is a conveyor assembly supported by the supporting framework 58. As shown, one or more hydraulic rams 58A can be provided to lift or tilt the conveyor assembly 60 upwardly for underside accessibility.

Figure 4:
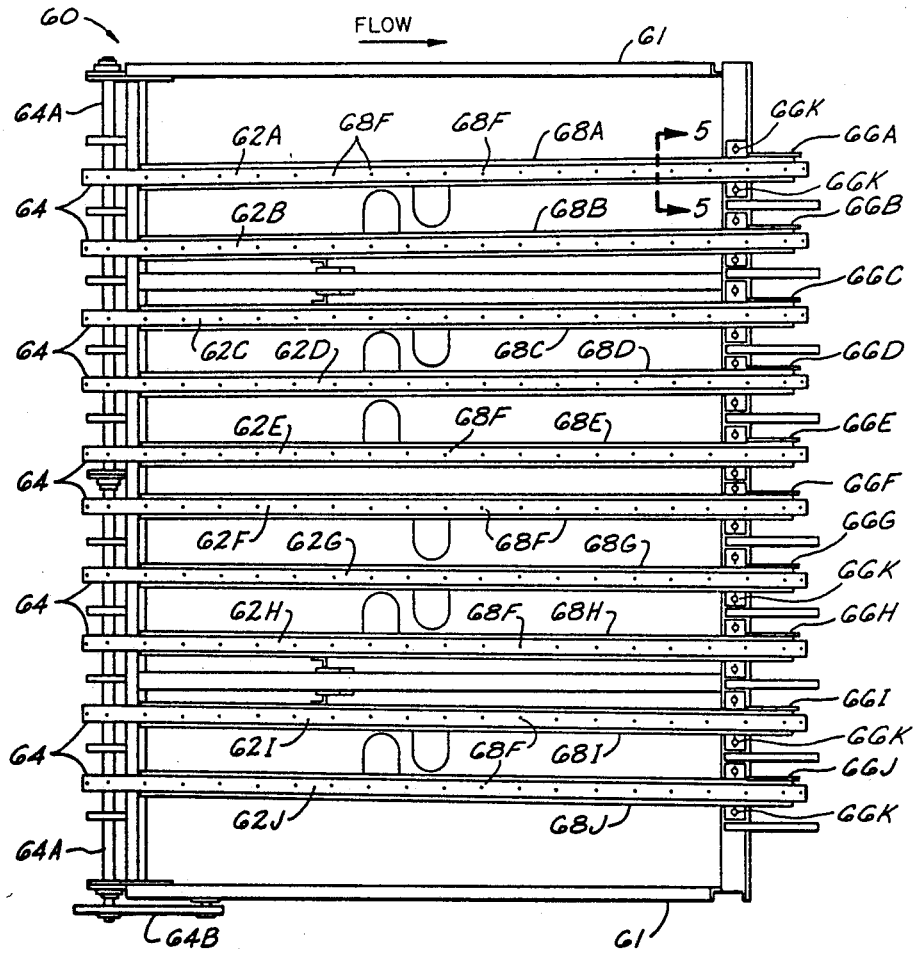
FIG. 4 is a top plan view of the feed station.

61 is a conveyor box frame which appears in FIG. 4.

62A through 62J are a plurality of conveyor belts.

64 depicts a plurality of sheaves supported at the lower end of the conveyor box frame 61 on a common drive shaft 64A which is supported by appropriately disposed journalled bearings along the end of the conveyor box frame 61. 64B depicts a drive belt assembly for rotating the sheaves 64 and thus the conveyor belts 62A–62J together in the direction indicated by the flow arrow.

66A through 66J depicts a plurality of individually journalled sheaves at the upper end of the conveyor box frame 61, each such sheave supporting its individual conveyor belt 62.

68A through 68J depicts a plurality of vacuum chambers supported beneath the upper runs of the conveyor belts 62A through 62J, as shown.

Figure 5:
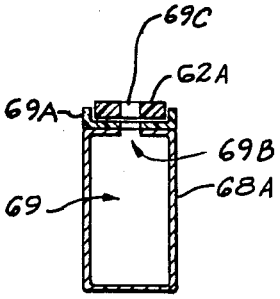
FIG. 5 is taken at 5—5 in FIG. 4.

69 depicts the hollow core of the vacuum chamber 68A which is shown in cross sectional view in FIG. 5 (taken at 5—5 in FIG. 4). A belt support member 69A is attached to the upper end of the vacuum chamber 68A and has upwardly extending edges to confine the belt 62A in its continuous travel along the length of the vacuum chamber 68A. The belt support member 69A can be made of a wear resistant, polymeric material, if desired. A slot 69B is provided in the upper end of the vacuum chamber 68A and in the belt support member 69A. A series of spaced apart apertures 69C are provided in the conveyor belt 62A which communicate via the slot 69B with the core 69 of the vacuum chamber 68A.

A conventional vacuum system is provided, part of which is shown beneath the feed station 14 in FIG. 1, to produce a vacuum in the core 69 and consequently at the apertures 69C in the conveyor belt 62A. It will be understood that the description for the conveyor belt 62A and its supporting structure also applies to the construction details of the remaining conveyor belts 62B through 62J and the supporting vacuum chambers 68B through 68J thereof. Thus, with applied vacuum, all of the conveyor belts 62A–62J present an array of traveling vacuum apertures 69C. As paperboard blanks are received onto the upper runs of the conveyor belts 62A through 62J, the blanks are moved up the incline of the conveyor assembly 60 and are fed to the vacuum conveyor assembly 18 as described further below.

It will be remembered from the description above that the sheaves 64 are commonly supported via the drive shaft 64A, while each of the sheaves 66A through 66J is individually supported on the opposing end of the conveyor box frame 61. The purpose of the latter arrangement is to permit some lateral adjustment to the conveyor belts 62A through 62J at the upper end of the conveyor box frame 61. That is, each of the sheaves 66A through 66J is supported (such as illustrated for sheaves 66A in FIG. 4) via bolts 66K through slotted flanges which support the sheaves 66A for rotation. This permits some lateral adjustment to each of the sheaves 66A through 66J in a lateral direction so that the spacing between the conveyor belts 62A–62J at the upper end of the box frame 61 can be selectively set to be greater at this end than at the lower end of the conveyor box frame 61. In other words, the conveyor belts 62A through 62J can be caused to diverge slightly in the direction of flow. Of course, the slack in the conveyor belts must be variable, so a conventional belt tension regulator (not shown) is provided which gives some slack during adjustment and then permits belt tightening. Also, the upper ends of the underlying vacuum chambers 68A–68J must be allowed lateral adjustment to track such lateral adjustment of the sheaves 66A–66J, such as by a slidable lip support (not shown).

The above described lateral adjustment is provided so that the paperboard blanks can be caused to separate slightly as such blanks are moved toward the upper end of the conveyor assembly 60. This small lateral separation given to the adjacent blanks is provided to prevent interference between adjacent blanks as these blanks are caused to fall into stacks in the downstacker station 16.

Figure 6:
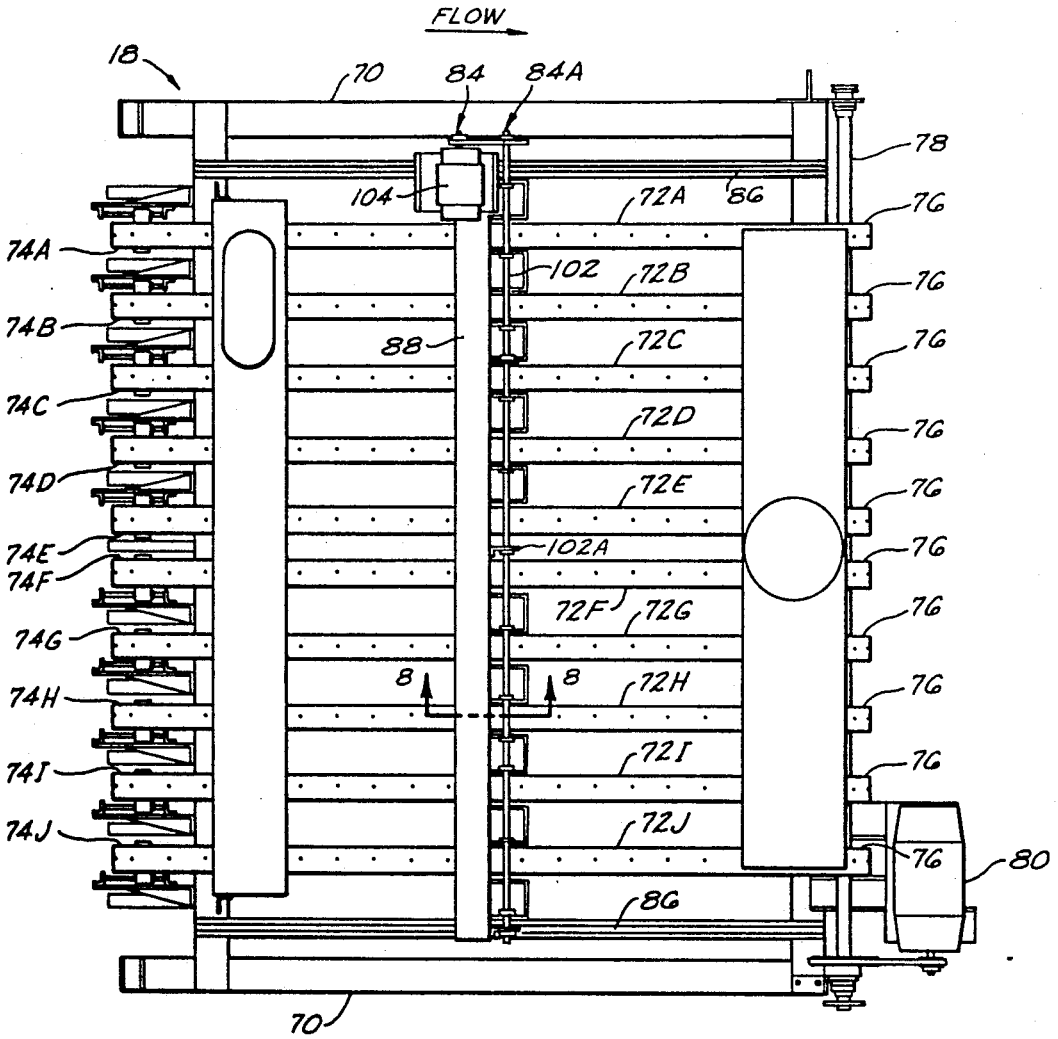
FIG. 6 is a top plan view of the vacuum conveyor station.

The vacuum conveyor station 18 is comprised of a plurality of parallel conveyor belts which serve to move the paperboard blanks from the feed station 14 to over a drop chute in the downstacker station 16. As shown in FIG. 6, the vacuum conveyor station 18 comprises the following structural details.

70 is a box frame which is pivotally supported at one end by a vertical frame of the downstacker station 16 described below, and rams 70A (one of which is shown in FIG. 1) are provided to raise the vacuum conveyor station 18 to the position shown in FIG. 1.

72 depicts a plurality of conveyor belts, with the individual belts being enumerated 72A through 72J.

74 and 76 depict plural sheaves supporting each of the conveyor belts 72, with 74A through 74J depicting the sheaves at one end and 76 depicting the sheaves at the other end of the frame 70. The sheaves 74A through 74J are individually supported with each being supported for slack adjustment of its respective conveyor belt.

78 depicts a common support shaft for all of the sheaves 76, the support shaft 78 being bearingly supported on the frame 70.

80 is a drive assembly for rotating the shaft 78 and consequently the sheaves 76 in unison to drive the conveyor belts 72A through 72J to move in the direction indicated by the flow arrow.

Figure 7:
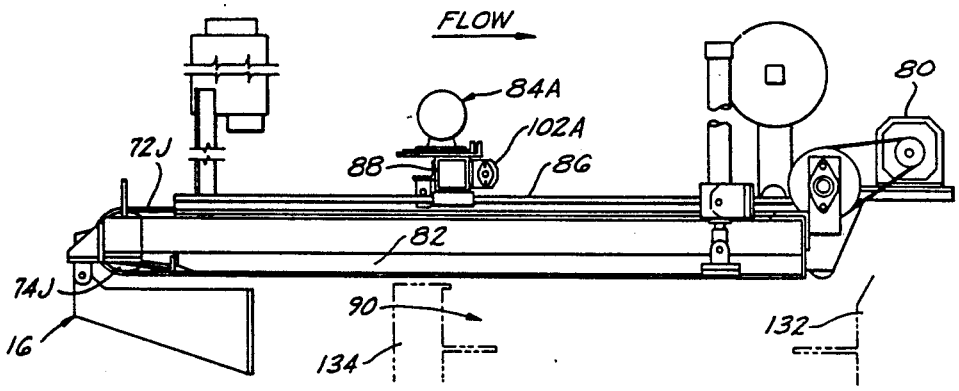
FIG. 7 is a semi-detailed, semi-schematic view in side elevation of the vacuum conveyor station.

82 depicts a plurality of vacuum chambers supported by the frame 70 beneath each of the conveyor belts 72A through 72J. One of the vacuum chambers is viewable in the semi-detailed view of FIG. 7. Each of the vacuum chambers is constructed similarly to the vacuum chambers 68 of the conveyor assembly 60, and the conveyor belts 72A–72J, which have a plurality of apertures similar to the above described conveyor belts 62, are caused to have vacuum suction in the same manner as the inclined conveyor of FIG. 4, with the exception that the vacuum chambers 82 are inverted so that the vacuum is provided along the bottom runs of the conveyor belts 72A–72J for the purpose discussed further below. The vacuum system used to create reduced pressure in the vacuum chambers 82 is conventional and need not be described.

84 is a blank impacting assembly which absorbs the momentum of the horizontally moving blanks and which separates the blanks from beneath the conveyor belts 72A through 72J. A portion of the blank impacting assembly 84 is depicted by 84A (FIG. 7) which is a blank striker assembly and which comprises the following construction details.

86 is a pair of rails, each of which is supported along one side of the frame 70.

88 is a lateral support beam slidingly supported by the rails 86 and locked thereto in the manner described below.

90 is a dropping chute in the downstacker station 16 disposed beneath the conveyor belts 72A–72J. In a manner to be made more clear below, the purpose of the blank striker assembly 84A is to apply striking forces to the blanks carried beneath the conveyor belts 72A–72J above the dropping chute 90 to separate the blanks from the vacuum conveyor station 18. Also, to be described hereinbelow, the blank impacting assembly 84 comprises a plurality of wheels which are disposed so as to be impacted by the forward edges of the paperboard blanks to cease the forward advancement of the blanks so that the blanks separated from the underside of the conveyor belts 72A–72J, are caused to fall in the drop chute in a predetermined angular disposition and to stack uniformly in the downstacker station 16.

Figure 8:
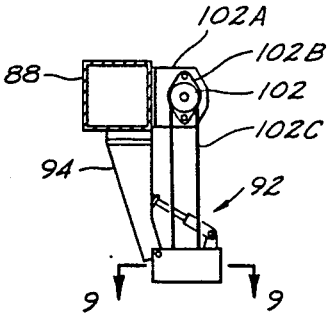
FIG. 8 is a view taken at 8—8 in FIG. 6.
Figure 9:
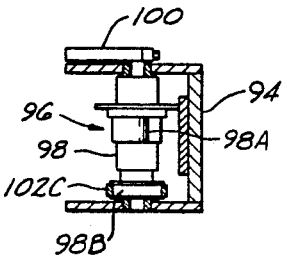
FIG. 9 is a view taken at 9—9 in FIG. 8.

92 depicts a plurality of strikers supported at intervals along the lateral support beam 88, one of the strikers 92 being shown in profile in FIG. 8, a description of which will be common for all of such strikers 92. The striker 92, as shown in FIGS. 8 and 9, comprises the following structural details.

94 is a support frame and brace attached to the underside of the lateral support beam 88.

96 is a striker device supported at the lower end of the frame 94 and comprises a spring clutch mechanism.

98 depicts the clutch body portion of the striker device 96 which is mounted for rotation on the support frame 94 and which has a locking gear 98A extensive therefrom. Not shown in the partial cutaway view of FIG. 9 is a spring mounted latch and solenoid mechanism which selectively engages the locking gear 98A. Also, the clutch body 98 has a pulley 98B.

100 is a rotatable striker arm connected to the clutch body 98. The clutch body 98 is a spring clutch of the type manufactured by Warner Electric Brake and Clutch Company of South Beloit, Illinois, and is preferably Model Number 275-1-0006, CB-2 series. The pulley 98B is mounted to one end of the clutch body 98 for rotating the striker device 96. As the pulley 98B is caused to rotate, the latch engages the locking gear 98A which sets the striker arm 100 at a predetermined rest position. The pulley 98B, however, is always free to rotate. When the solenoid (not shown) is energized, the latch is lifted and the striker arm 100 can rotate with the pulley portion 98A. The striker arm 100 is spatially disposed beneath the lateral support beam 88 between a pair of adjacent conveyor belts 72 so as to be in position to strike a paperboard blank carried at the underside of the conveyor belts 72.

102 is a drive shaft bearingly supported via several bearing supports 102A along one side of the lateral support beam 88 and having a plurality of pulleys 102B, one each of such pulleys 102B being provided for each striker 92. A pulley belt 102C is driven by each of the pulleys 102B and drivingly engages the pulley 102B of each striker 92.

104 is a power assembly provided to rotate the drive shaft 102 and thus to drive all of the pulleys 98B of the strikers 92 together. This provides for the striker arms 100 to react in unison as the solenoids of the clutches 98 are energized together, thereby providing multiple striking blows against the paperboard blanks across the underside of the vacuum conveyor station 18.

Figure 10:
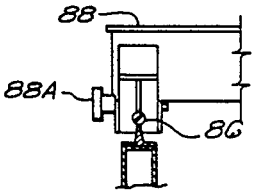
FIG. 10 is a partially detailed depiction of the side rail support of the lateral support beam of the vacuum conveyor station.

As depicted in FIG. 10, each end of the lateral support beam 88 is supported by one of the rails 86, and a locking member 88A is provided so as to secure same thereto at a selected location along the rails 86. The purpose of this is to enable the positioning of the blank striker assembly 84A such that the strikers 92 are disposed just over the rear portions of the paperboard blanks repardless of the size of the blanks (that is, within the confines of the machine dimensions). This results in the strikers 92, driven in unison, being caused to strike the blanks at a predetermined position and in a timed manner as described more fully below, to knock the rear portions of the blank downward away from the underside of the vacuum conveyor belts 72.

Returning to FIG. 1, depicted as supported within the pit 22 is the downstacker station 16. More specifically, the downstacker station 16 is comprised of the following construction details.

110 is a vertically extending box frame which is partially disposed within the pit 22 and which has a stacking compartment and an unstacking compartment designated by the following numerals.

112 is the stacking compartment which is open on the side shown and which has a slidable safety door 112A guarding access to the dropping chute 90.

114 is the unstacking compartment which is open as shown and which has a slidable safety door 114B guarding access to entry thereof.

116 is a stacking assembly portion of the downstacker station 16 and is disposed in the dropping chute 90 beneath the vacuum conveyor station 18 for receiving the falling blanks and for forming adjacently disposed stacks of paperboard blanks.

118 is a first elevator or conveyor portion of the stacking assembly 116, and which is disposed within the stacking compartment 112. The first elevator 118, also sometimes herein referred to as a platform assembly, has a set of conventionally powered rollers 118A that are driven by a power source to rotate counter-clockwise (in FIG. 2) to move paperboard blanks in the direction of the flow arrow. Not shown is a chain and sprocket arrangement, conventional in nature with counterweights, for selectively lifting and lowering the first elevator 118 within the stacking compartment 112. The rollers 118A serve as a platform surface for receiving blanks falling in the drop chute into stacks; as the stacks form, the first elevator 118 is progressively lowered by conventional power and control circuitry until a selected stack height is formed.

120 is a stack retrieval assembly disposed within the unstacking compartment 114 and comprises a second elevator or conveyor 120A which, in similar manner to that of the first elevator 118, is supported by a conventional chain and sprocket arrangement (not shown) which is capable of selectively raising and lowering the second elevator 120A. In its lowered position, the second elevator 120A is aligned with the first elevator 118 (in its lowered position) to receive stacks of paperboard blanks therefrom. The second elevator 120A also has a set of conventionally powered rollers.

122 is a stack pusher assembly (viewable in FIG. 1) which is disposed to move the stacks received on the second elevator 120A in the direction of the flow arrow. The stack pusher assembly 122 has an arm which is positionable across the second elevator 120A once the stacks are received thereon, the arm being supported on each side of the second elevator 120A via traveler members which are driven via powered chain drives. The stack pusher assembly 122 is necessary to move stacks.

124 depicts a receiving conveyor disposed at an outlet opening of the unstacking compartment 114. In discharging the stacks of collected blanks from the stack retrieval assembly 120, the second elevator 120A is elevated to align with the receiving conveyor 124, at which time the stack pusher assembly 122 is activated to push the stacks onto the receiving conveyor 124 for removal via conventional means (not shown).

126 is a dunnage clamp assembly which is supported by the frame 110 at the end of the receiving conveyor 124. This dunnage clamp assembly 126, shown in partial detail in FIG. 17, has a stationary frame member 126A which has an upstanding first gripping member 126B extending the width of the receiving conveyor 124.

128 is a second gripping member pivotally attached at its lower edge to the stationary frame member 126A.

130 is a conventional pancake type cylinder having an extendible member attached to the second gripping member 128 for selectively pivoting the second gripping member 128 to the open position depicted in FIG. 17 and to a closed position in which the second gripping member 128 is pivoted to bear against the first gripping member 126B.

The purpose of the dunnage clamp assembly 126 is to permit the placement and retention of dunnage under the stacks pushed from the second elevator 120A onto the receiving conveyor 124, the dunnage being necessary for the binding straps placed about the stacks during the colligation process. Prior to receiving the stacks on the receiving conveyor 124, one edge of a piece of dunnage, typically a flexible sheet of cardboard or the like, is placed between the first gripping member 126B and the second gripping member 128 (in the open position), and the cylinder 130 is actuated to close the second gripping member 128 to securely grip the dunnage. The dunnage is then folded downwardly so as to overlay the end of the receiving conveyor 124. Once the stacks of blanks are pushed onto the dunnage, the cylinder 130 is actuated to open the second gripping member 128 to release the dunnage and to permit the stacks and dunnage to be moved along the receiving conveyor 124.

Continuing now with other portions of the downstacker station 16, and more specifically with the blank impacting assembly 84, disposed within the stacking compartment 112 is a stationary backstop and a movable backstop, the details of which will now be discussed.

132 and 134 depict, respectively, the stationary backstop and the movable backstop, as viewable in the semi-detailed, partial schematic of FIG. 11. This figure is provided to give a general layout of these two backstops, the construction details of which will follow. Discussion will first be given with reference to FIGS. 12 and 12A which are views of the stationary backstop 132.

136 is a laterally extending frame supported by the box frame 110.

138 is a support arbor which extends across, and is bearingly supported on, the frame 136. A power train (not shown) connected outboard to the support arbor 138 for bidirectional rotation thereof.

140 depicts a plurality of cushion wheels supported along the arbor 138 and which are disposed to be in the horizontal path of the paperboard blanks carried by the lower run of the vacuum conveyor assembly 18. That is, cushion wheels 140, having a semi-flexible striking surfaces, are disposed in the advancing path of the blanks so as to be struck by the leading edges of the blanks when the blanks are advanced over the dropping chute 90. The rear portions of the blanks having just been struck downward blows by the strikers 92, the cushion wheels 140 impart a stopping force to the leading edges of the blanks, thusly effecting an angular disposition to the falling blanks, preferably with the rear edges of the blanks falling before the leading edges thereof. The arbor 138 supports and rotates the cushion wheels 140 in unison at a relatively low rotational speed just sufficient to present fresh impact surfaces regularly to the impacting blanks. The direction of rotation of the cushion wheels 40 is selected such that, upon impact by the blanks, the blanks will be caused to rebound with a proper force component. That is, it may be necessary to set the rotational direction differently, to modify the speed, or even stop the rotation for any particular paperboard blank as the characteristics of such blanks can vary greatly. In general, a downward vector at the leading edges of the blanks will be desired, as this assists in the dropping motion of the blanks. However, experience seems to indicate that other blank characteristics, such as pliancy of the leading edges, will also bear upon the rotational direction selection.

The movable backstop 134 has a good many similarities to that discussed above for the stationary backstop 132, and more details of same will be provided hereinbelow. Meanwhile, with further discussion of the stationary backstop 132, it will be noted that this unit also serves to support portions of the stacking assembly 116; more specifically, the stationary backstop 132 supports part of a tamper assembly which serves to tamper the edges of the blanks as stacks of paperboard blanks are formed to provide substantially uniform sides to such stacks, and details of such tamper assembly are to be found in FIGS. 12 through 16.

Figure 12:
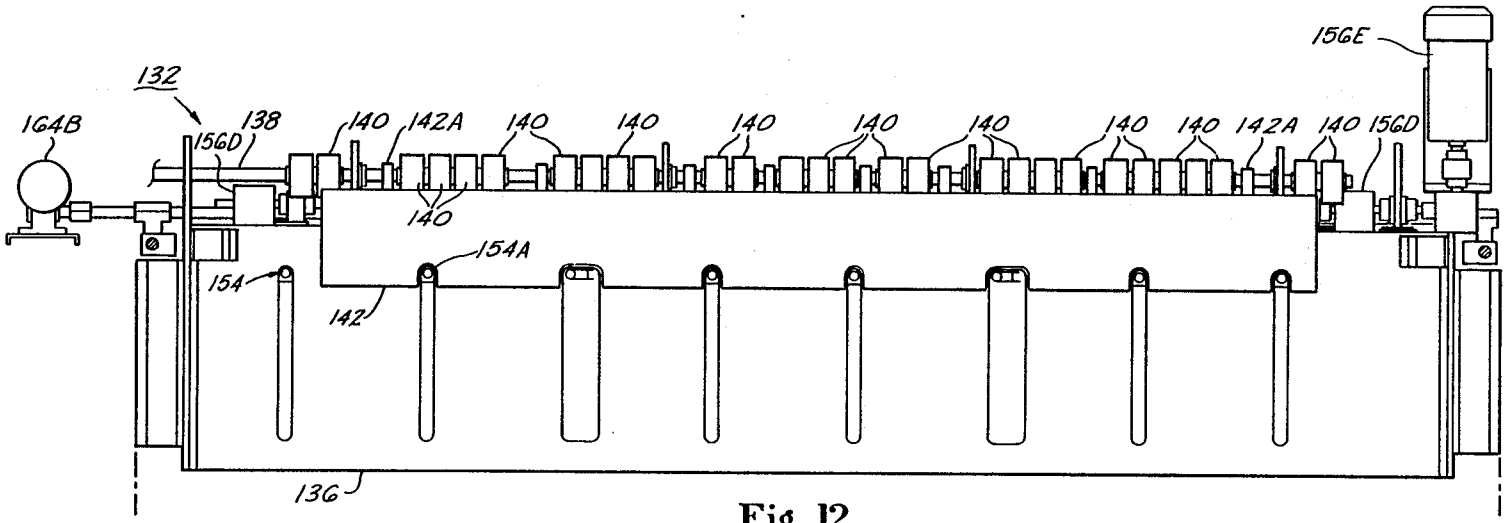
FIGS. 12 and 12A are front elevational and top plan views, respectively, of the stationary backstop.
Figure 12A:
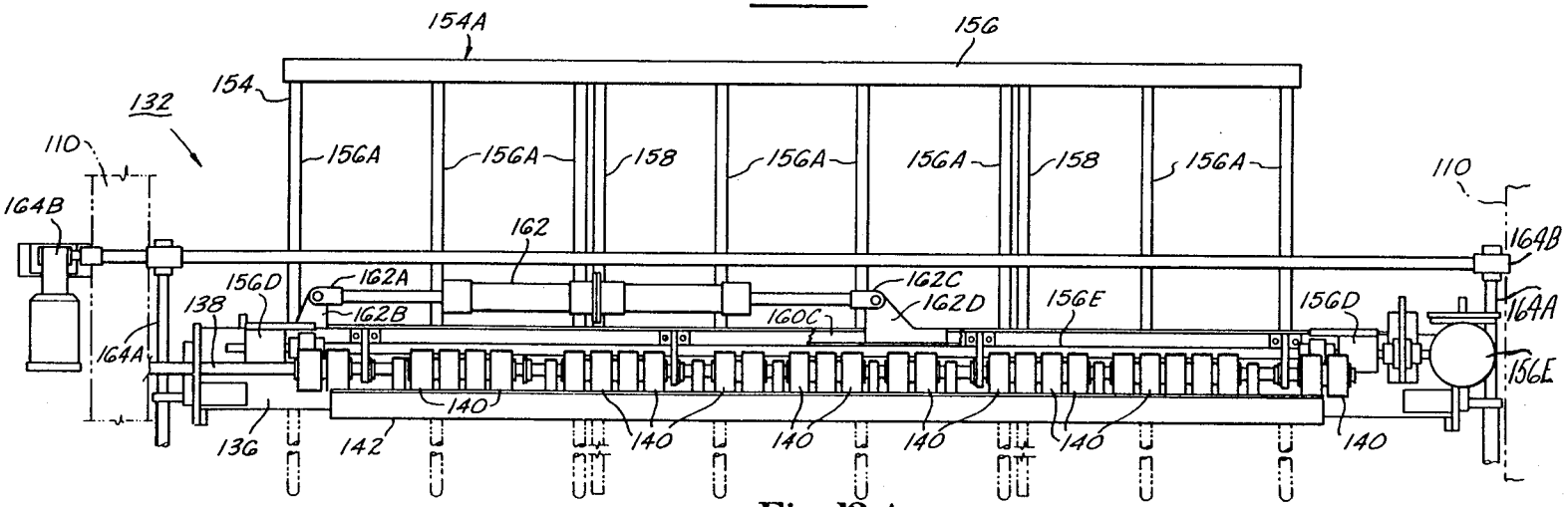
Figure 12B:
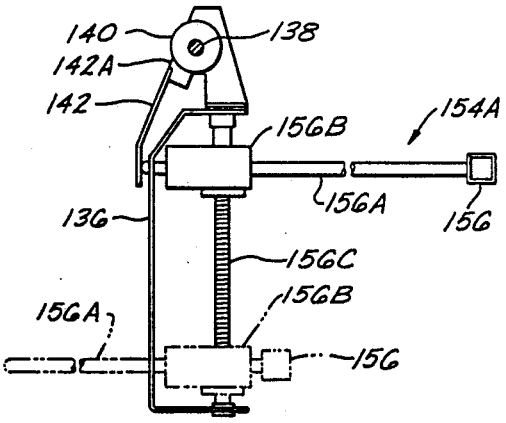
FIG. 12B is a side elevational, schematic representation of a portion of the stack staging assembly supported by the stationary backstop.
Figure 12C:
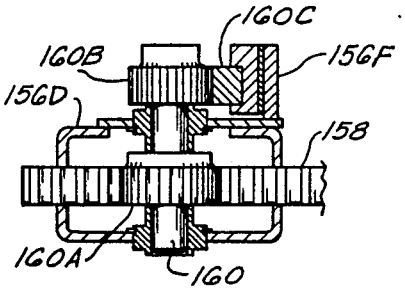
FIG. 12C is a partial cutaway view of the fork extension mechanism.
Figure 12D:
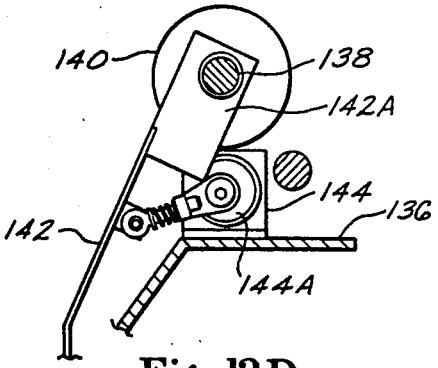
FIG. 12D is a partial detailed, side elevational view of a portion of the tamper assembly supported by the stationary backstop.

142 is a tamper plate bearingly supported by the arbor 138 via hanging tabs 142A as shown in FIG. 12D.

144 depicts a powered cam mechanism which has several rotatable cams 144A that are connected to the tamper plate 142 via spring linkages as shown. Rotation of the cams 144A causes the tamper plate 142 to oscillate, and the disposition of the tamper plate 142 in front of the cushion wheels 140 causes the tamper plate 142 to tamper the leading edges of the blanks as such form stacks in the dropping chute 90.

Figure 15:
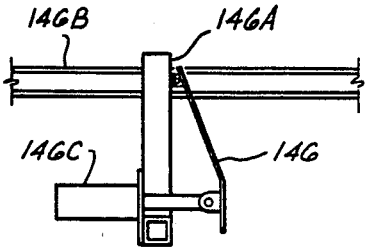
FIG. 15 is a side elevational, semi-detailed view of one of the side tamper plates.

146 is a tamper plate shown in FIG. 15 in partial detail. The tamper plate 146 is pivotably supported by a cantilever frame 146A which is slidably supported on a rail member 146B which, although not shown in FIG. 12 and 12A, is mounted to the frame 136 and extends therealong above the cushion wheels 140. The frame 146A can be attached to a laterally extending screw member to move it to a position such that the tamper plate 146 is disposed adjacent to the outside edges of one of the outermost stacks formed on the first elevator 118. An oscillator cylinder 146C, upon activation via a power source (not shown), oscillates the lower end of the tamper plate 146 to tamp the outside edges of the stacks being formed in the dropping chute 90. Another tamper plate, identical in construction to the tamper plate 146, is provided on the opposite side stacks to tamp the opposing edges of the stacks. The laterally extending screw member, provided with two sections of oppositely pitched threads, can be rotated to move the tamper plates toward or away from each other to define the width of the dropping chute 90.

Figure 16:
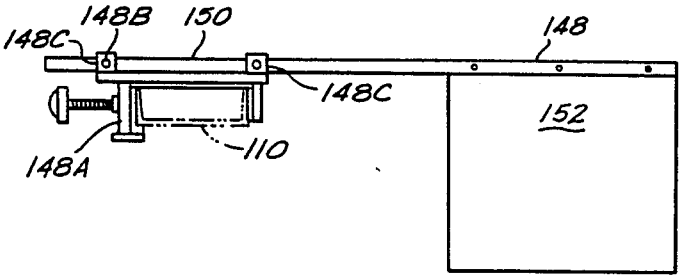
FIG. 16 is a side elevational view of a flexible curtain mechanism.

Because the paperboard blanks are separated via the above discussed divergence imparted by the conveyor assembly 60 of the feed station 14, the stacks will tend to form with gaps between adjacent stacks on the first elevator 118. While these gaps serve the useful feature of preventing side interference between falling blanks in the dropping chute 90, it is desirable that the stacks be brought together once formed, as such gaps remaining between stacks, when banded on the receiving conveyor 124, will result in a certain amount of difficulty as the bundled stacks are transported. To prevent this ill effect, the present invention provides flexible curtains extending between adjacently disposed stacks to permit sufficient edge tampering to bring adjacent stacks into near touching, but not overlapping, disposition. One such curtain mechanism is shown in FIG. 16, where the following numeral designations are found.

148 is a flexible curtain mechanism which has a clamping support frame 148A.

150 depicts a slide rail frame variously extendible from the support frame 148A and which is set at a desired extension via set screws 148B in support loops 148C. As shown, the support frame 148A can be positionable along a lateral rail portion of the box frame 110 at a desired position, or if desired, the support frame of the curtain mechanism 148 can be configured to be supported by the rail member 146B (mentioned above for the tamper plates 146) and can cantilever out therefrom to permit proper placement.

152 is a flexible curtain member supported by the slide rail frame 150 to hang between adjacent stacks being formed on the platform surface of the first elevator 118 to provide a flexible backup between stacks of blanks while being tamped by the tamper plate 142 and tamper plates 146 so that adjacently forming stacks are made to be in near touching engagement with substantially no gap therebetween. As the first elevator 118 is lowered during stack formation, the curtain member 152 is caused to be withdrawn from between the stacks. The number of such curtain member 152, and the size thereof, will be determined by the number of stacks and the size of the paperboard blanks.

The stacking assembly 116 also includes a stack staging assembly which is positionable beneath the vacuum conveyor station 18 for collecting falling blanks after a selected stack height has been achieved on the first elevator 118. That is, it is desirable that the flow of paperboard blanks be continuous and not interrupted during the time necessary to transfer the stacks from the first elevator 118 to the second elevator 120A. To this end, the following construction details of the stack staging assembly are provided, starting first with reference to FIGS. 12 and 12A.

154 is a portion of the stack staging assembly, of which 154A is a first fork set. The first fork set 154A comprises the following construction details.

156 is a lateral beam member from which a plurality of fork members or tines 156A extend. A side profile is viewable in FIG. 12B. The fork members 156A are slidably supported via a bearing block 156B supported at the ends thereof via guide posts (not shown) and via a plurality of screw members 156C which are in turn supported by the frame 136. As shown, the forks are extensive through slots in the front of the frame 136. Internal to the bearing block 156B are appropriately disposed bearings (not shown) to slidingly support the fork members 156A; also internal to the block 156B are gear members which interact with the screw members 156C such that, upon rotation of the screw members 156C via conventional interconnected gear boxes 156D and power train 156E, the forks 156A, and consequently the lateral beam member 156, can be raised and lowered relative to the frame 136 as the bearing blocks 156B are moved along the screw members 156C, via the power train 156E. The dashed lines in FIG. 12B indicate the fork members 156A in a lowered and extended position. Extension and retraction of the fork members 156A is accomplished as follows.

158 depicts a pair of rack gear members supported by the lateral beam member 156 and extensive parallel to the fork members 156A. The partial cutaway view of FIG. 12C shows a portion of one of these rack gear members in greater detail.

160 is one of a pair of a rotatable arbors bearingly supported by the bearing block 156B, and as shown in FIG. 12C, each of the arbors 160 has a lower gear 160A is disposed to interact with one of the rack gear members 158 extensive through the bearing block 156B. 160B depicts a top gear which is supported by each arbor 160 and which is disposed to interact with a rack gear 160C. The rack gear 160C will be more clearly viewable with reference to FIG. 12A once again, where the rack gear 160C is partially viewable in a cutaway detail.

162 is a double acting cylinder which is supported by the bearing block 156B with a first end thereof, depicted as 162A, attached to a tab member 162B extensive from the bearing block 156B, and a second end 162C of the cylinder 162 connected to the rack gear 160C via a tab member 162D extensive therefrom. With selective actuation of the cylinder 162 fluid power control (not shown), the rack gear 160C is caused to slide laterally relative to the bearing block 156B.

Returning to FIG. 12C, it will be noted that the rack gear 160C is slidably retained on the bearing block 156B via a support member 156F in conventional manner. Again, as the cylinder 162 is actuated, the rack gear 160C is moved thereby, interacting with the top gears 160B to rotate the arbors 160. This causes the rotation of the lower gears 160A, which causes the rack gear members 158 to move relative to the bearing block 156B. Since the rack gear members 158 are attached to the lateral beam member 156, this causes the beam member 156 to move toward or away from the bearing block 156B, thereby causing the fork member 156A to move between the retracted and extended positions relative to the frame 136. More about this in the discussion of the second fork set supported in similar fashion on the movable backstop 134 will clarify the function of these fork sets.

Figure 13:
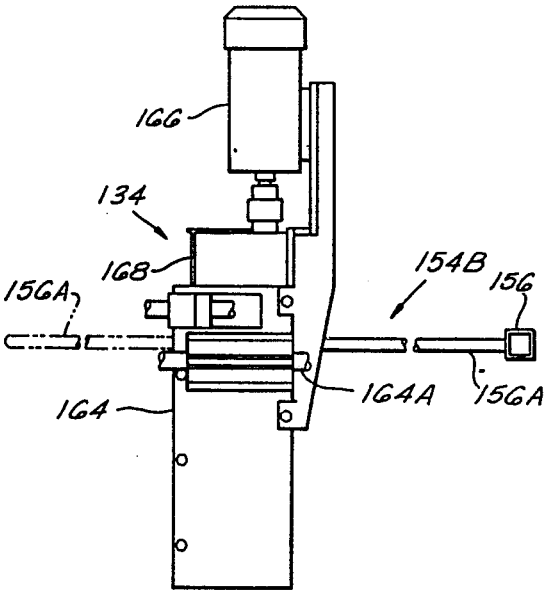
FIG. 13 is a side elevational, semi-detailed view of the movable backstop.
Figure 14:
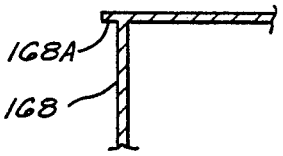
FIG. 14 is an enlarged view of a portion of the movable backstop shown in FIG. 13.

Turning to FIG. 13, therein is depicted a side elevational view of the movable backstop 134 in which the components thereof are enumerated as follows.

164 is a laterally extending frame slidingly supported to each end via a pair of support rails (not shown) which are in turn supported by the box frame 110. Also, a pair of screw rails 164A are provided to selectively move and position the frame 164. The screw rails 164A also appear in FIGS. 12 and 12A where a drive train 164B is shown for the simultaneous rotation of the screw rails 164A to move the movable backstop 134 to a desired position along the screw rails 164A via interaction therewith by appropriately disposed gears (not shown) in the frame 164.

166 depicts a portion of a power train which drives a laterally disposed arbor (not shown) to effect the raising and lowering of the second fork set 154B. The structural details of the second fork set 154B are identical to that provided above for the first fork set 154A and need not be provided herein as such is not deemed necessary. Instead, like numerals will indicate the same component members of the second fork set 154B. Accordingly, the second fork set 154B also comprises a laterally extending beam member 156 and a plurality of fork members 156A that are extendible and retractable relative to the frame 164 via a bearing block 156B supported and positionable via appropriately disposed, but not shown, screw members 156C. A cylinder 162 is also provided, together with its rack gear 160C, supported appropriately to actuate the components discussed above with reference to FIG. 12C for the movable backstop 134, the result being the selective extension and retraction of the second fork set 154B.

The first and second fork sets 154A and 154B are extendible toward each other and intermesh somewhat to form a temporary cradle beneath the vacuum conveyor station 18 to receive falling paperboard blanks to permit removing of stacks of the blanks on the first elevator 118 without stopping the flow of such blanks. Further, as the extended first and second fork sets 154A, 154B collect falling blanks in the temporary cradle provided thereby, the first and second fork sets 154A, 154B are progressively lowered via the supporting screw members 156C. Once the first elevator 118 has been lowered and cleared of its stacks of blanks, the first elevator 118 is again raised to just below the forks of the first and second fork sets 154A, 154B, and the fork members 156A thereof are simultaneously retracted in order to transfer the collected blanks to the upper platform surface of the first elevator 118.

A final detail of the movable backstop 134 will be noted. The positioning of the movable backstop 134 is determined along the supporting screw rails 164A to define the length of the dropping chute 90 to accommodate the size of paperboard blanks being downstacked from the die cutter assembly 24. Thus, the movable backstop 134 is positioned so as to serve as a back boundary at the rear edges of the blanks carried over the dropping chute 90 via the vacuum conveyor station 18. FIG. 13, again referenced, shows the movable backstop 134.

168 depicts a panel member supported by the frame 164 which serves as the back boundary of the falling blanks in the dropping chute 90. A portion of the panel member 168 is shown in enlarged view in FIG. 14 where 168A depicts an overhanging lip portion thereof. The purpose of the lip portion 168A is to permit clearance to the falling blanks in the dropping chute 90, but also, to prevent upward flight of the rear edges of the blanks as the blanks rebound from impact with the cushion wheels 140 of the stationary backstop 132. This feature has proven helpful to prevent the trailing edges of the blanks from going upward into the advancing path of following blanks, and it is believed to be useful in the avoidance of some potential jams.

It will be appreciated that the above description necessarily is brief and does not include many details of construction of the downstacker assembly 10. However, such details that have been provided will be sufficient for the practice of the invention as the details omitted are well within the knowledge of persons of ordinary skill in the related field. Further, the following discussion of a control system for the downstacker assembly 10 should prove helpful in an understanding of the operation thereof.

Figure 18:
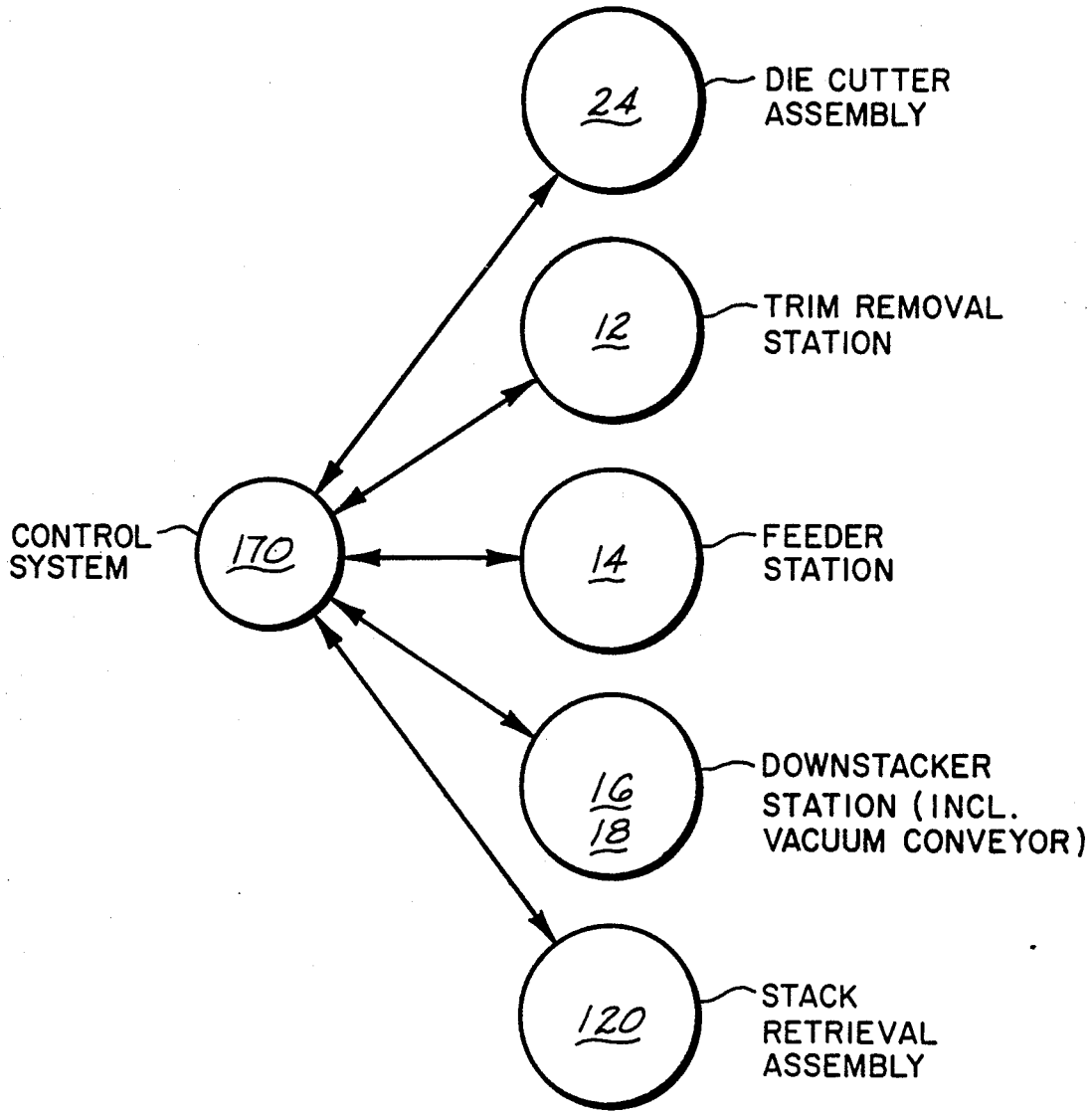
FIG. 18 is a schematic diagram of the control system for the downstacker assembly.

170 in the schematic diagram of FIG. 18 represents a control system which ties together the operations of the various stations and assures a continuous operation of the progressive steps in the work performed by the downstacker assembly 10. The control system 170 first controls the flow of paperboard blanks from the die cutter assembly 24. The die cutter assembly 24 does not form a part of the present invention, as the downstacker assembly 10 may find usefulness in other unit operations involving blanks and the like. Nevertheless, the control system 170 is tied in a control sense to the die cutter assembly 24 in order to command responses from the several work stations of the downstacker assembly 10 in a coordinated manner appropriate to the blanks provided by the die cutter assembly 24.

The above description makes clear that a number of motor drives are used throughout the downstacker assembly 10 to drive the blanks from input at the trim removal station 12 to where the blanks are caused to fall by the cooperative efforts of the strikers 92 and the cushion wheels 140 into stacks formed beneath the vacuum conveyor station 18. A conventional manner of counting and tracking the location of blanks through this journey, although travelling at high linear speeds, is practiced, for example, by the use of shift register and computer controls. The art of shift register control is well known, and information readily available, such as from the General Electric Company and other manufacturers, is incorporated herein by reference. General Electric Series One Programming, GEK-25375, is one such shift register and programming guide which is available.

In a shift register setup, a group of data collection and storage locations are synchronized by timing signals generated at motor locations at the various work stations. This data is sent to, and accumulated by, the shift register stations and the central control system 170. Thus, the number of blanks and location of same are tracked, beginning with the die cutter assembly 24, as shown in FIG. 18, to include the trim removal station 12, the feed station 14, the downstacker station 16 (including the vacuum conveyor station assembly 18), and the stack retrieval assembly 120. This permits the control system 170 to be programmed to stop the die cutter assembly 24, which stops the feed of paperboard blanks to the trim removal station 12 for a predetermined time interval to create a gap between blanks flowing through the downstacker assembly 10, the purpose of which will now be discussed.

With reference to the discussion of the stack staging assembly found hereinabove, it will be remembered that the fork members 156A are caused to be positioned beneath the vacuum conveyor assembly 18 to form a temporary cradle to catch the falling blanks during the time interval of stack removal from the first elevator 118. While it is possible to move the fork members 156A into cradle position during the time in which blanks are falling in the dropping chute 90, the probability of causing blank interference by such fork insertion increases as the rate of blank flow is increased. It has been determined that blank jams of this type can be eliminated by providing a gap of about a three second duration in the flow of blanks. This is effected by the control system 170 signalling a time delay to the die cutter assembly 24, after which time the die cutter assembly 24 again is caused to feed blanks to the trim removal station 12. This gap in the flow of paperboard blanks can be electrically tracked so that the arrival of the gap at the dropping chute 90 is known, and the fork members 156A of the stack staging assembly can be extended across the dropping chute 90 during the gap time without interference with the falling blanks.

Other features of the control system 170, such as the operations of starting and stopping, jogging and speed controlling of the downstacker assembly 10, will be commonly known and need not be described herein. It will be appreciated then that the control system 170 will be a useful feature of the downstacker assembly 10.

FIG. 19

Figure 19:
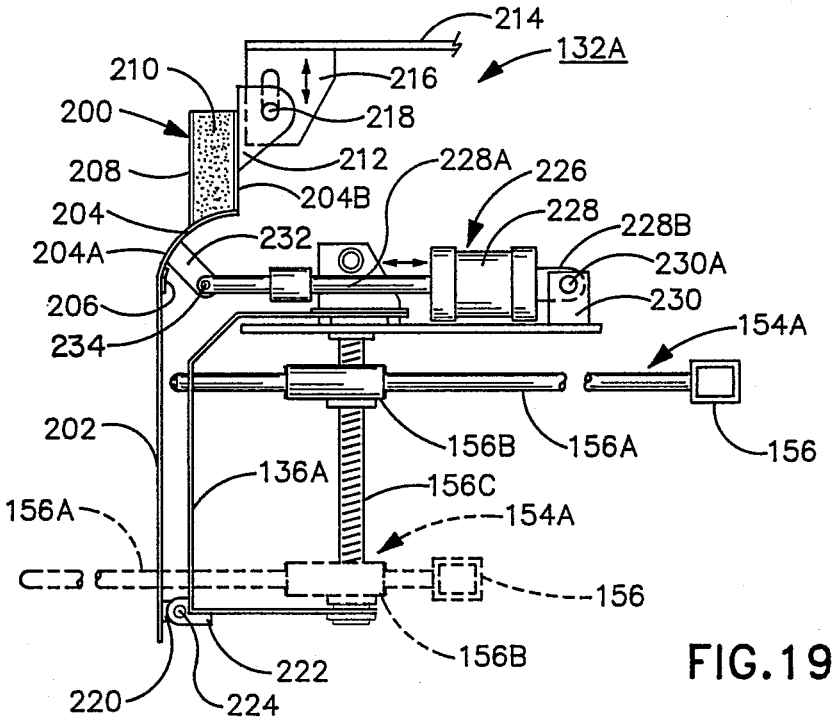
FIG. 19 is a side elevational, schematic representation of a portion of the stack staging assembly and stationary backstop with an alternative tamper assembly.

FIG. 19, a view in partial detail, is similar to FIG. 12D and is included because it shows a side view of a modified tamper plate assembly. As depicted therein:

200 is a semi-flexible tamper plate assembly supported by the modified stationary backstop 132A.

202 is a vertical lower tamper plate member similar to the tamper plate 142 of FIG. 12B.

204 is an upper tamper plate member having a curved lower portion 204A and an upwardly extensive planar portion 204B.

206 is a bonded urethane flexible plate connector which serves to interconnect the lower tamper plate member 202 to the curved lower portion 204A.

208 is a flexible blank striking surface supported by the upper tamper plate member 204 and can also be made of bonded urethane or the like. The blank striking surface 208 replaces the plural cushion wheels 140 and serve the same purpose. That is, the blank striking surface 208 is disposed in the advancing path of the paperboard blanks so as to be struck by the leading edges of the blanks when the blanks are advanced over the dropping chute 90. It was pointed out hereinabove that, in some applications, the cushion wheels 140 would be used in a stationary mode. When such stationary mode is predominant, the blank striking surface 208 can be provided.

210 is a resilient foam cushion provided between the blank striking surface 208 and the planar portion 204B of the upper tamper plate member 204. The cushion 210 serves to strengthen the blank striking surface 208 while remaining sufficiently pliant to absorb energy from the impact of the blanks while not damaging same.

212 is a tamper plate mounting bracket extensive from the planar portion 204B.

214 is a tamper plate suspension arm which is supported by the frame of the stationary backstop 132A at any convenient location (not shown).

216 is one of a plurality of slide brackets disposed along, and extensive from, the tamper plate suspension arm 214. Each of the slide brackets 216 has a vertically extending slot.

218 is one of a plurality of slide pins, each such slide pin 218 supported in an aperture of one of the tamper plate mounting bracket 212 and slidably received in the vertical slot of one of the slide brackets 216 in the manner shown.

220 is one of a plurality of lower tamper plate support brackets extensive from the tamper plate member 202 along its lower end.

222 is one of a plurality of frame pivot brackets disposed along the laterally extending frame 136A.

224 is one of a plurality of pivot pins, each such pivot pin 224 interconnecting one of the lower tamper plate support bracket 220 to one of the frame pivot brackets 222 as shown.

226 is a horizontal tamper plate actuator assembly which includes:

228 is one of a plurality of actuator cylinders which are hydraulic or pneumatic cylinders interconnected to extend or retract in unison. Each such actuator cylinders 228 has an actuator arm 228A and a support bracket 228B.

230 is one of several actuator mounting brackets supported by the frame of the stationary backstop 132A to which the support brackets 228B are connected via connector pins 230A.

232 is one of several tamper plate connector brackets extensive from the upper tamper plate member 204.

234 is one of several connector pins, each such connector pins 234 connecting the extending end of one of the actuator arms 228A of the actuator cylinders 228 to one of the tamper plate connector brackets 232 as shown.

As mentioned above, the actuator cylinders 228 of the tamper plate actuator assembly 226 are actuated by a fluid circuit (not shown) which conventionally acts to rapidly alternate between extension and retraction of the actuator arm 228A of the actuator cylinders 228 so as to pivot the lower tamper plate member 202 about the pivot pins 224 to impart oscillation motion to the lower tamper plate member 202 for the same reason as discussed above for the tamper plate 142. That is, as the lower tamper plate member 202 is oscillated by the tamper plate actuator assembly 226, the disposition of the lower tamper plate member 202 below the blank striking surface 208 causes the lower tamper plate member 202 to tamp the leading edges of the paperboard blanks as such form stacks in the dropping chute 90.

FIG. 20

It will be remembered that the blank impacting assembly 84 was described hereinabove as serving the functions of absorbing the momentum of the horizontally moving blanks and of separating the blanks from beneath the conveyor belts 72A through 72J of the vacuum conveyor station 18. The blank impacting assembly 84, described in detail above, includes the blank striker assembly which included the lateral support beam 88 and a plurality of strikers 92 supported at intervals therealong for providing multiple striking blows against the paperboard blanks across the underside of the vacuum conveyor assembly 18. These striking blows, as described above, are delivered to the rear of the blanks, and nearly simultaneously, the blanks impact the cushion wheels 140 to stop the leading edges of the blanks, thereby causing the blanks to fall into the dropping chute 90.

Figure 20:
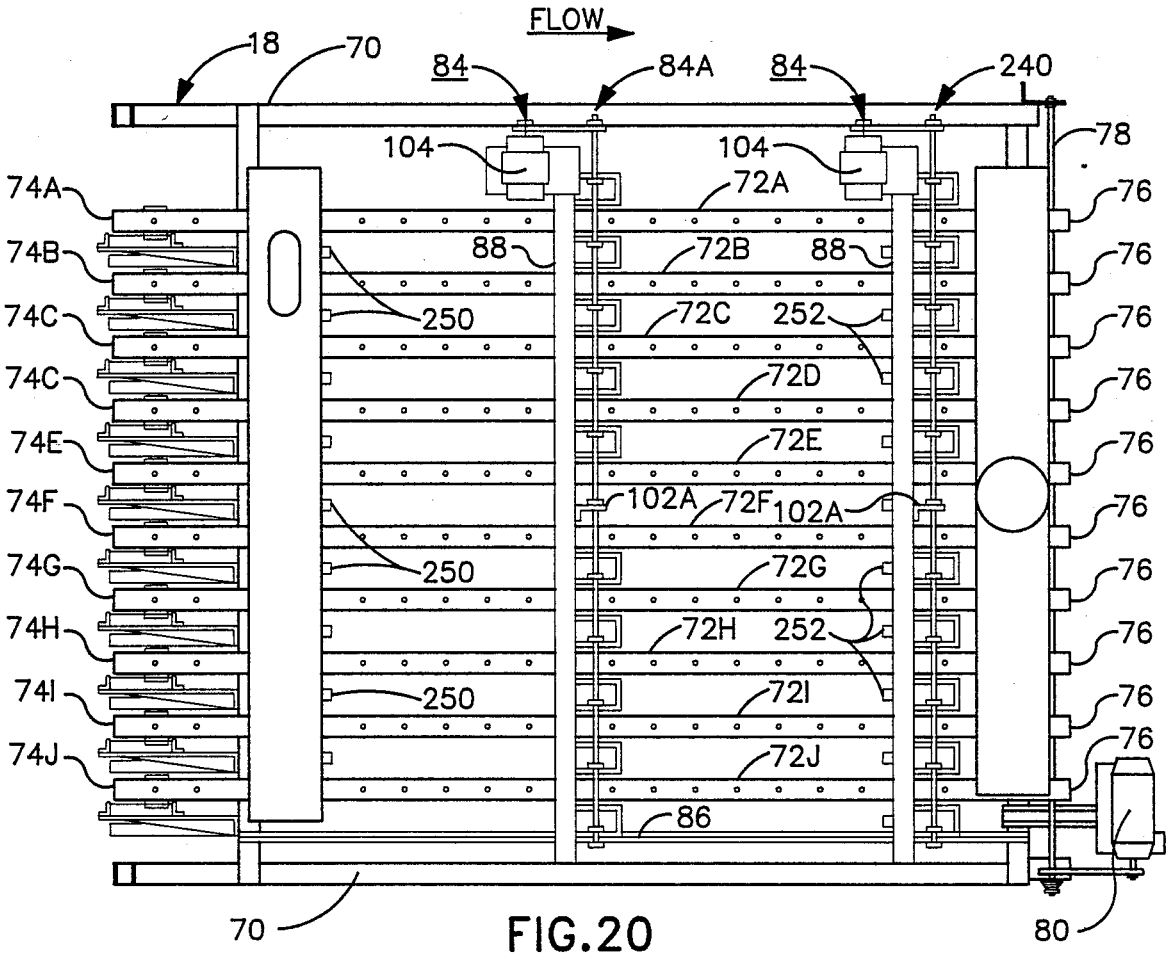
FIG. 20 is a top plan view of the vacuum conveyor station in which dual blank impacting assemblies are included.

While the above described structural and operational arrangement has proven to be quite satisfactory, an alternate structural and operation arrangement will now be described with reference to FIG. 20, which is a top plan view of the vacuum conveyor station 18. The structure in FIG. 20 is identical to that in FIG. 6 with the exception, as will now be explained, that dual blank striker assemblies are provided. Since these are identical in structure, like numerals designate like elements therein, except that the blank impacting assembly 84 (described above with reference to FIG. 6) includes both the first blank striker assembly 84A and a second blank striker assembly as follows:

240 is a second blank striker assembly identical in construction to the first blank striker assembly 84A. That is, the second blank striker assembly 240 has a second lateral support beam 88 slidingly supported by the rails 86, and a plurality of strikers 92, described hereinabove, are supported at intervals along the second lateral support beam 88.

In operation, the strikers 92 of the second blank striker assembly 240 operate in unison, as do the strikers 92 of the first blank striker assembly 84A. As discussed above, the strokers 92 deliver multiple striking blows against the paperboard blanks across the underside of the vacuum conveyor station 18, with the strikers 92 of the first blank striker assembly 84A disposed along the rails 86 to strike the rear portions of the paperboard blanks, while the strikers 92 of the second blank striker assembly 240 positioned along the rails 86 to strike the forward portions of the paperboard blanks. The timing of these blows is determinable and controlled as discussed above, and it will be appreciated that the sequence of blow delivery can be established as may be required for any particular board characteristic. Thus, the blows to forward portions of the blanks to effect a downward force thereon can be delivered prior to, simultaneously with, or subsequent to the blow delivery by the strikers 92 to the rear portions of the paperboard blanks.

It has been determined that the inclusion of the second blank striker assembly 240 provides a greater degree of flexibility and increased dropping predictability in many applications of the downstacker assembly 10.

Also shown in FIG. 20 are a plurality of photoelectric sensor members, as follows.

250 depicts a plurality of first sensors; and 252 depicts a plurality of second sensors.

The first and second sensors 250, 252 are depicted schematically in FIG. 20 as being disposed near the ends of the vacuum conveyor assembly 18. That is, the first sensors 250 are supported to detect the presence of paperboard blanks as such leave the feed station 14 and first commence passing below the conveyor belts 72. The second sensors 252 are supported conveniently along the lateral support beam 88 in a position to sense the forward portions of the paperboard blanks as the blanks first impact and then drop before the tamper plate assembly 200.

The first and second sensors 250, 252 are conventional photoelectric cells of the type having a relatively short focal length such that the detection range of the sensors is selectively confined to the detection of objects close thereto. The sensors 250, 252 are conventionally powered, and the signals therefrom are provided to the control system 170 to serve as a jam indicator for the blanks passing beneath the sensors 250, 252 as follows.

The first sensors 250 sense the leading edges of boards and starts a shift register count, such shift register determined to count in increments of ¼ inch. This permits electronic surveillance (in memory) as the boards move beneath the vacuum conveyor assembly 18 until the boards are in position for the strikers 90 of the first and second blank impacting assemblies 84A, 240 to strike both the forward and rearward portions of the boards, usually simultaneously.

Upon detecting the leading edges of the boards, the control system ignores the first three inches of the boards if the first sensors 250 sense a break or gap, which is interpreted as scrap.

As mentioned above, encoders convert rotational speeds of system drive motors to linear velocity. The reaction time of the strikers 92 is accounted for so that the shift register location of the boards is changed at the time that the strikers 92 are actuated.

The second sensors 252 are set to see and clear within a certain time. If the second sensors 252 do not see a gap (caused by the boards falling below the short focal length thereof), the second sensors 252 provides a continuing signal to the control system 170, which is interpreted as a jam. At this time, and upon this happening, the control system 170 first interrupts the feed from the die cutter assembly 24 for an interval amounting to two board lengths; if the second sensors 252 then sense a gap, the control system 170 returns the die cutter assembly 24 to full speed. If no gap is sensed, this interrupt is prolonged, the vacuum is shut off to both the feed station 14 and vacuum conveyor assembly 18, the trim removal section 12 is continued long enough to sufficiently clear stock from the die cutter assembly 24, after which all systems are shut off. The operator can then clear the jam and commence operations again.

FIGURES 21–23

The dunnage clamp assembly 126 was discussed hereinabove with reference to FIG. 17. The purpose of the dunnage clamp assembly 126 is to permit placement and retention of dunnage under stacks of paperboard blanks pushed from the second elevator 120A onto the receiving conveyor 124. The dunnage, typically a flexible sheet of cardboard, is gripped along one edge while the stacks are pushed thereonto via the stack pusher assembly 122. This arrangement provides for the placement of single-tier stacks on the receiving conveyor 124, and the present invention addresses the desired feature of multiple-tier loads as follows.

Figure 21:
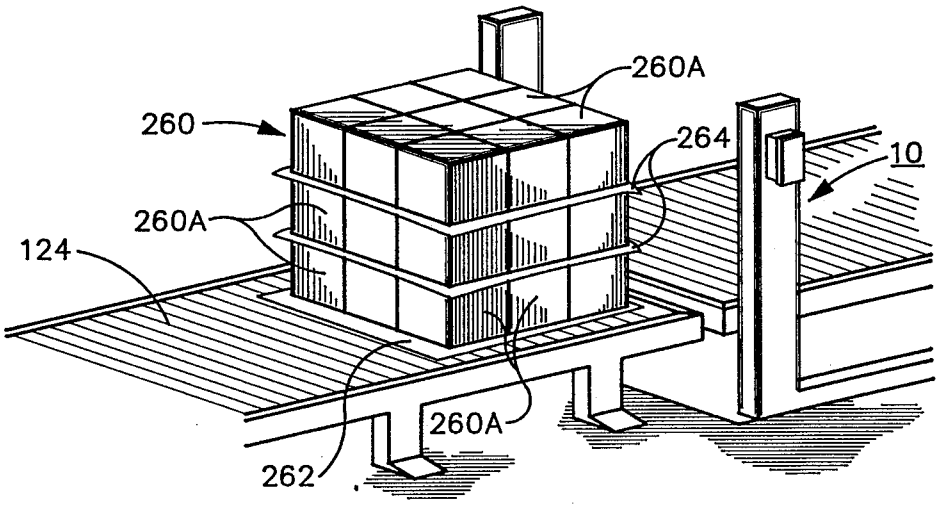
FIG. 21 is a schematic representation of a multiple-tier load of stacks formed on the receiving conveyor as discharged from the downstacker assembly.

260 in FIG. 21 is a multiple-tier load of paperboard blank stacks 260A that have been discharged from the downstacker assembly 10 onto the receiving conveyor 124.

262 is a dunnage sheet which has been positioned beneath the load 260 as the stacks 260A have been discharged from the downstacker assembly 10.

264 are dunnage sheets placed between tiers or layers of the stacks 260A. The dunnage sheets 264 are also sometimes referred to as tie sheets since these sheets serve to stabilize the load when banding or strapping is used to unitize the load 260 by a conventional banding machine.

Figure 23:
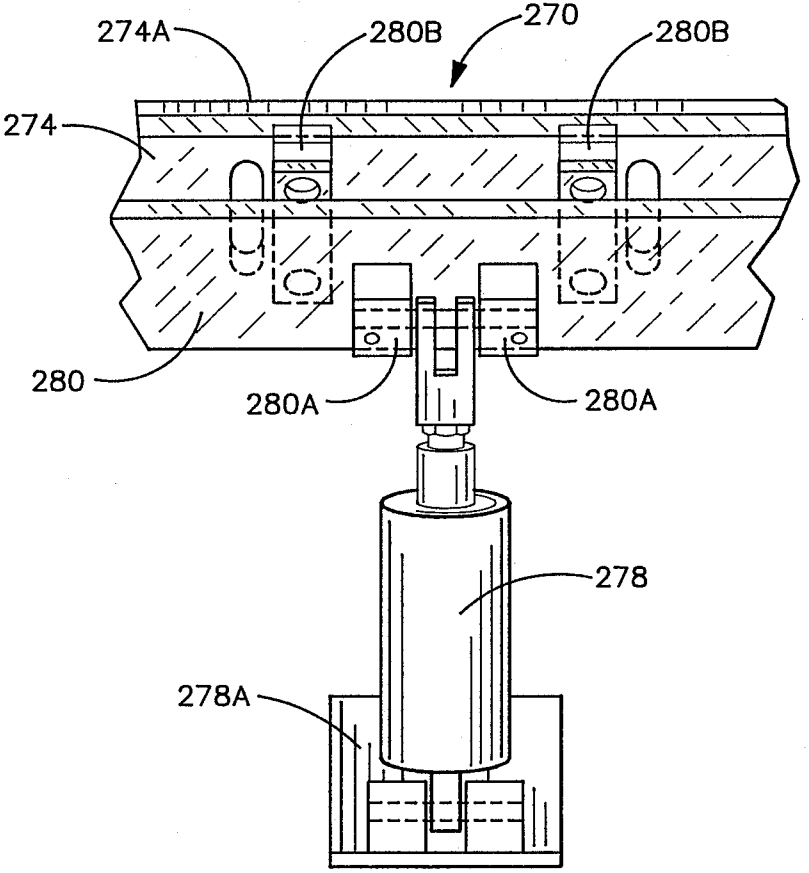
FIG. 23 is an enlargement of a portion of the dunnage holding assembly shown in FIG. 22.
Figure 24:
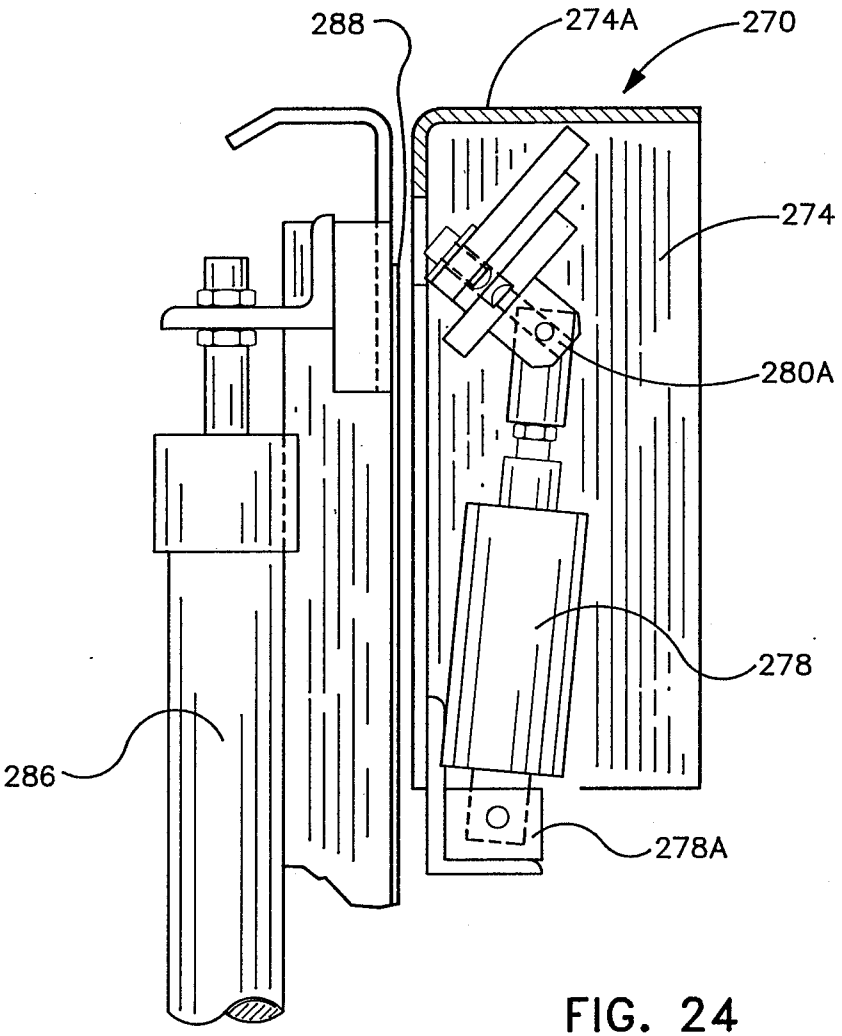
FIG. 24 is a partial cross-sectional view of the dunnage holding assembly shown in FIG. 22.

Achieving the multiple-tier load depicted in FIG. 21 is the task of the structure which will now be described with reference to FIGS. 22 through 24 in which appears the following.

270 is a dunnage holding assembly which is mounted at the discharge end of the vertically extending box frame 110 and partially supported in the pit 22 so as to avoid interference with stacks discharged from the stack retrieval assembly 120 and the receiving conveyor 124. In short, the dunnage holding assembly 270 takes the place of the dunnage clamp assembly 126 and is located in the same relative disposition. In this regard, the dunnage holding assembly 270 comprises the following:

272 are vertically rising support members having track portions 272A and supported by the box frame 110.

274 is a laterally extending frame member slidably detained on the tracks 272A of the support members 272. The frame member 274 has an upper gripping lip portion 274A.

276 is a fluid actuator having its upper end attached to the frame member 274 and having its lower end connected to brackets (not shown) supported either by the concrete floor or the vertically extending box frame 110. The fluid actuator 276 is a hydraulic or pneumatic extendible cylinder of conventional construction and actuated by a fluid circuit controlled by an operator switch (not shown).

278 depicts a plurality of fluid actuators supported on the frame member 274 via an equal number of support brackets 278A.

280 is a laterally extending gripping bar having a plurality of connectors 280A extensive therefrom and which are connected to the upper ends of the fluid actuators 278. Disposed along the gripping bar 280 are several upwardly extending gripping tabs 280B.

Figure 22:
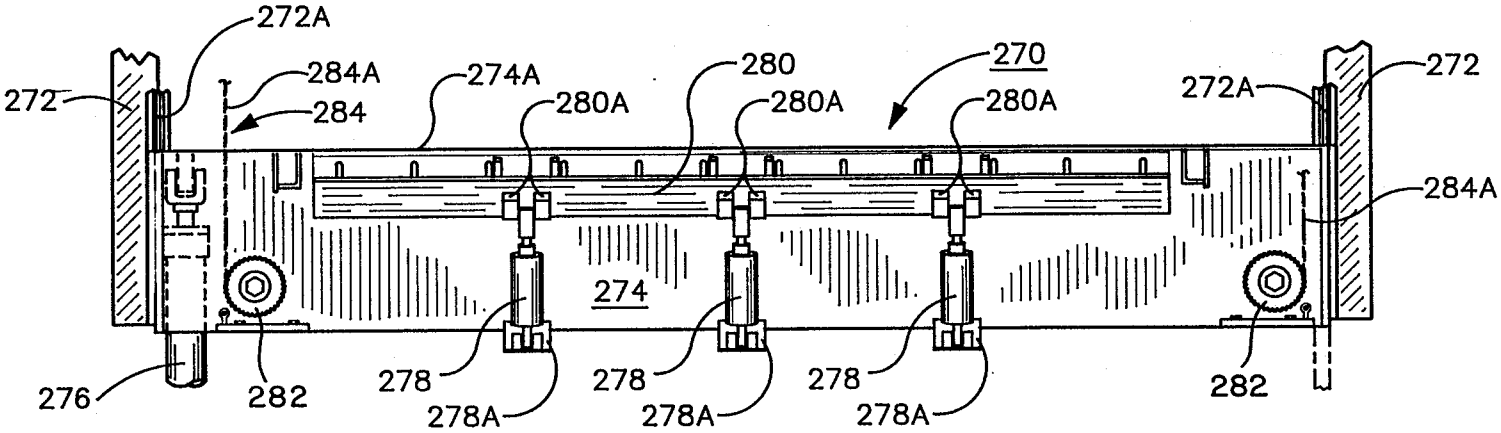
FIG. 22 is a side elevational view of a dunnage holding assembly.

282 depicts a pair of double sprockets rotationally mounted on the frame member 274 at opposing ends, as shown in FIG. 22.

284 is a chain assembly mounted over the sprockets 282 and having chain support portions 284A which are vertically extensive segments each of which is connected to a chain hanging bracket (not shown) on the vertically rising support members 272. The chain assembly 284 virtually supports the bulk of the weight of the dunnage holding assembly 270 so that the single fluid actuator 276 can position the laterally extending frame member 274 at any deired position along the tracks 272A.

286 is one of a pair of other fluid actuators supported near the laterally extending frame member 274.

288 is a laterally extending and vertically extendible safety screen member supported by the upper ends of the fluid actuators 286. With the extension of the fluid actuators 286, the safety screen member 288 is caused to rise so as to form a safety shield at the end of the pit 22 across the end of the vertically extending box frame 110.

In operation, the dunnage sheet is placed over the end of the receiving conveyor 124 at a time prior to the discharge of the paperboard blank stacks 260A and when the fluid actuator 276 has been retracted to lower the laterally extending frame member 274. In the lowered position, the gripping lip portion 274A of the laterally extending frame member 274 is disposed approximately even with the upper surface of the rollers of the receiving conveyor 124. An edge of the dunnage sheet 262 is disposed between the gripping lip 274A and the laterally extending gripping bar 280. The fluid actuators 278 are extended by the operator to cause the edge of the dunnage sheet 262 to be retained between the gripping lip 274A and the gripping tabs 280B as the fluid actuators 278 raise the laterally extending gripping bar 280. The body of the dunnage sheet 262 is at this point extending over and supported by the rollers of the receiving conveyor 124, and it will be retained in this position while the lower layer of stacks are pushed upon the dunnage sheet 262 via the pusher assembly 122 in multiple discharge of the downstacker assembly 10. Once the lower layer of the load 260 has been formed, the dunnage sheet 262 is released from gripping engagement by the dunnage holding assembly 270 as the operator retracts the fluid actuators 278. The frame member 274 is then elevated by the operator's extension of the fluid actuator 276 so that the gripping lip 274A is substantially even with the top surface of the first layer. One of the dunnage sheets 264 is gripped by the dunnage holding assembly 270 in the manner discussed above for the dunnage sheet 262, and the body of the dunnage sheets 264 is laid over the top of the first layer of the load 260. The second elevator 120A is programmed to elevate the stacks to the elevation necessary for the stack pusher assembly 122 to push the stacks over the frame member 274 and onto the dunnage sheets 264 to form the second layer of the load 260. Once formed, the third and subsequent layers are formed in the same manner. Once the load 260 is completed, other sheets of dunnage (not shown) can be placed over its top layer and the receiving conveyor 124 can be activated to transport the load 260 to a location for binding.

During the operation of multiple-tier load forming described above, it is advisable that the pit 22 be shielded via the safety screen member 280 to prevent personnel accidents. This can be achieved by programming the extension and retraction of the fluid actuators 286 between stack discharge from the downstacker assembly 10.

It is clear that the present invention is well adapted to carry out the objects and to attain the ends and advantages mentioned herein as well as those inherent in the invention. While a presently preferred embodiment of the invention has been described for purposes of this disclosure, numerous changes may be made which will readily suggest themselves to those skilled in the art and which are accomplished within the spirit of the invention disclosed and as defined in the appended claims.

What is claimed is:

1. An improved downstacker assembly for stacking paperboard blanks in which plural rows of blanks are sequentially passed for stacking each paperboard blank having a forward portion with a leading edge and a rear portion with a rear edge, the downstacker assembly comprising:

a. vacuum conveyor means for holding and advancing the rows of blanks beneath lower runs of the conveyor means to be disposed over a drop chute, the drop chute comprising a pit disposed below the vacuum conveyor means, the pit having sufficient depth below the floor level elevation of the downstacker assembly to permit the forming of stacks of blanks beneath the vacuum conveyor means;

b. impacting means for applying appropriately directioned forces to the blanks above the drop chute to cease forward advancement of the blanks and to separate the blanks from the vacuum conveyor means so that the blanks of each row are caused to fall in the drop chute, the impacting means comprising:

(1) a striking surface disposed in the advancing path of the blanks to be struck by the leading edges of the blanks when the blanks are advanced to be over the drop chute; and (2) blank striker means for impacting the forward and rear portions of the blanks so as to knock the blanks away from the vacuum conveyor means just prior to impact of the leading edges of the blanks so that the rear edges of blanks are caused to be below the leading edges thereof to avoid interference with succeeding blanks advanced to above the drop chute by the vacuum conveyor means;

c. stacking means disposed in the drop chute beneath the vacuum conveyor means for receiving the falling blanks from each row and for forming a stack of blanks for each row of blanks, such stacks being formed in adjacent disposition, and the stacking means comprising:

(1) platform means having a platform surface for receiving the blanks falling in the drop chute in stacked disposition, the platform means comprising:

(a) first elevator means supporting the platform surface and disposed beneath the vacuum conveyor means for selectively lowering the platform surface as the blank stacks are formed thereupon; and (b) a first power conveyor having a plurality of conveyor rollers which provide the platform surface of the platform means, the first power conveyor supported for selected ascent and descent by the first elevator means; and (2) tamper means for tamping the edges of the blanks as the stacks are forming to provide substantially uniform sides to the stacks being formed on the platform means, the tamper means comprising:

(a) curtain means disposed to hang between adjacent stacks being formed on the platform means for providing flexible backup means between such stacks while being tamped so that the adjacent stacks are disposed in near touching engagement with substantially no gap between adjacent stacks; and d. stack retrieval means for receiving the blank stacks from the platform means after same is lowered in the pit and for elevating the blank stacks to at least floor level elevation for disposition therefrom via a selected material handling device, the stack retrieval means comprising:

(1) a second power conveyor having a plurality of conveyor rollers which receive the blank stacks thereupon;

(2) second elevator means supporting the second power conveyor for selectively ascending and descending the second power conveyor in the pit, the conveyor rollers of the first and second power conveyors being selectively rotatable to move the blank stacks from the first power conveyor to the second power conveyor when aligned in the pit;

(3) dunnage holding means for selectively gripping a dunnage sheet at a selected height; and (4) stack pusher means for moving the blank stacks off-loaded from the second power conveyor onto the dunnage sheet grippingly held by the dunnage holding means.

2. The downstacker assembly of claim 1 wherein the stacking means comprises:

stack staging means, selectively disposable beneath the vacuum conveyor means, for collecting falling blanks after a selected stack height has been achieved on the first power conveyor and for transferring the collected blanks to the first power conveyor following unloading of the stacks therefrom, the stack means being withdrawn from beneath the vacuum conveyor means after transfer of collected blanks is achieved.

3. The downstacker assembly of claim 2 wherein the stack staging means comprises:

a first fork set;

a second fork set, the first and second fork sets having an extended position in which the forks thereof cooperatively form a temporary cradle disposed beneath the vacuum conveyor means to receive falling blanks, and having a retracted position in which the forks are withdrawn from below the vacuum conveyor means; and fork support means for disposing the first and second fork sets selectively in the closed position and in the retracted position, the fork support means altering the elevation of the fork sets as required to lower the temporary cradle formed thereby beneath the vacuum conveyor means as the blanks stack thereon.

4. The downstacker assembly of claim 3 wherein the stack staging means comprises:

interrupt means for momentarily interrupting the passing of blanks to the downstacker assembly to provide a gap in the passage of blanks to the vacuum conveyor means during the interval when the fork sets are being moved from the retracted position to the closed position.

5. The downstacker assembly of claim 4 wherein the blanks are received from a die cutter assembly which repeatedly cuts the blanks from paperboard material having excess trim sections to be removed from the blanks, the downstacker assembly further comprising:

trim removal conveyor means receiving the blanks and trim from the die cutter assembly for removing the trim from the blanks as the blanks are moved toward the vacuum conveyor means.

6. The downstacker assembly of claim 4 wherein the blank striker means comprises:

first blank striker means positionable at a selected location along the vacuum conveyor means for impacting the rear portions of the blanks; and second blank striker means positioned above the striking surface of the impacting means for impacting the forward portions of the blanks.

7. The downstacker assembly of claim 6 wherein the interrupt means comprises:

sensor means disposed to sense and track the blanks traveling beneath the vacuum conveyor means for detecting blank jams beneath the vacuum conveyor means and for interrupting the passing of blanks to the downstacker assembly when a jam is detected.

8. The downstacker assembly of claim 1 wherein the dunnage holding means comprises:

a laterally extending frame member;

support means for supporting and elevating the laterally extending frame member at various heights so that the laterally extending frame member is positionable at substantially the same selected height as that of the stack retrieval means; and gripping means cooperating with and supported by the laterally extending frame member for selectively gripping a dunnage sheet disposed to be supported by the selected material handling device and by already discharged blank stacks so that multiple-tier loads of blank stacks are formable having dunnage sheets between tiers thereof.

9. The downstacker assembly of claim 8 wherein the support means comprises:

track means for supporting the laterally extending frame member and for providing vertical travel therealong; and actuator means for elevating and lowering the laterally extending frame member to selected heights along the track means.

10. The downstacker assembly of claim 9 wherein the gripping means comprises:

a laterally extending gripping bar having at least one gripping tab extensive therefrom; and actuator means supported by the laterally extending frame member for selectively moving the gripping bar toward a gripping lip portion of the laterally extending frame member so that a dunnage sheet is retainable between the gripping tab and the gripping lip portion.

11. An improved downstacker assembly for stacking paperboard blanks in which rows of blanks are sequentially passed for stacking, each paperboard blank having a forward portion with a leading edge and a rear portion with a rear edge, the downstacker assembly comprising:

a. vacuum conveyor means for holding and advancing the blanks beneath a lower run thereof over a drop chute which comprises a pit disposed below the vacuum conveyor means, the pit having sufficient depth below the floor level elevation of the downstacker assembly to permit the forming of blank stacks beneath the vacuum conveyor means;

b. impacting means for applying appropriately directioned forces to the blanks above the drop chute to cease forward advancement of the blanks and to separate the blanks from the vacuum conveyor means so that the blanks are caused to fall in the drop chute, the impacting means comprising:

(1) a striking surface disposed in the advancing path of the blanks so as to be struck by the leading edges of the blanks when the blanks are advanced to be over the drop chute; and (2) blank striker means for impacting the forward and rear portions of the blanks to knock the blanks away from the vacuum conveyor means just prior to impact of the leading edges of the blanks with the striking surface;

c. stacking means disposed in the drop chute beneath the vacuum conveyor means for receiving the falling blanks and for forming adjacently disposed stacks of blanks, the stacking means comprising:

(1) platform means having a platform surface for receiving the blanks falling in the drop chute in stacked disposition, the platform means comprising:

(a) first elevator means supporting the platform surface and disposed beneath the vacuum conveyor means for selectively lowering the platform surface as the blank stacks are formed thereupon; and (b) a first power conveyor having a plurality of conveyor rollers which provide the platform surface of the platform means, the first power conveyor supported for selected ascent and descent by the elevator means;

(2) tamper means for tamping the edges of the blanks as the stacks are forming to provide substantially uniform sides to the stacks being formed on the platform means, the tamper means comprising:

(a) curtain means disposed to hang between adjacent stacks being formed on the platform means for providing flexible backup between such stacks while being tamped so that the adjacent stacks are disposed in near touching engagement with substantially no gap between adjacent stacks;

(3) stack staging means, selectively disposable beneath the vacuum conveyor means, for collecting falling blanks after a selected stack height has been achieved on the first power conveyor and for transferring the collected blanks to the first power conveyor following unloading of the stacks therefrom, the stack means being withdrawn from beneath the vacuum conveyor means after transfer of collected blanks is achieved, the stack staging means comprising:

(a) a first fork set;

(b) a second fork set, the first and second fork sets having an extended position in which the forks thereof cooperatively form a temporary cradle disposed beneath the vacuum conveyor means to receive falling blanks, and having a retracted position in which the forks are withdrawn from below the vacuum conveyor means;

(c) fork support means for disposing the first and second fork sets selectively in the closed position and in the retracted position, the fork support means altering the elevation of the fork sets as required to lower the temporary cradle formed thereby beneath the vacuum conveyor means as the blanks stack thereon; and (d) interrupt means for momentarily interrupting the passing of blanks to the downstacker assembly to provide a gap in the passage of blanks to the vacuum conveyor means during the interval when the fork sets are being moved from the retracted position to the closed position;

d. stack retrieval means for receiving the blank stacks from the platform means after same is lowered in the pit and for elevating the blank stacks to at least floor level elevation for disposition therefrom via a selected material handling device, the stack retrieval means comprising:

(1) a second power conveyor having a plurality of conveyor rollers which receive the blank stacks thereupon;

(2) second elevator means supporting the second power conveyor for selectively ascending and descending the second power conveyor in the pit, the conveyor rollers of the first and second power conveyors being selectively rotatable to move the blank stacks from the first power conveyor to the second power conveyor when aligned in the pit;

(3) dunnage holding means for selectively gripping a dunnage sheet at various selected heights; and (4) stack pusher means for moving the blank stacks off loaded from the second power conveyor onto the dunnage sheet grippingly held by the dunnage holding means and supported by a selected material handling device; and wherein the blanks are received from a die cutter assembly which repeatedly cuts the blanks from paperboard material having excess trim sections to be removed from the blanks, the downstacker assembly further comprising:

e. trim removal conveyor means receiving the blanks and trim from the die cutter assembly for removing the trim from the blanks as the blanks are moved toward the vacuum conveyor means, the trim removal conveyor means comprising:

(1) a support frame; and (2) a sandwich conveyor assembly supported by the support frame and comprising:

(a) a lower rope conveyor assembly having a pair of spaced apart arbors supported by the support frame for rotation and having a plurality of endless rope conveyor elements disposed over the spaced apart arbors for traveling movement thereby;

(b) an upper web conveyor assembly comprising:

1. a pair of spaced apart arbors supported by the support frame rotation;

2. at least one flexible, endless web belt disposed over the spaced apart arbors for traveling movement thereby; and 3. beater means disposed over the lower run of the web belt for imparting vibratory motion thereto; and (c) power means for providing powered rotation to one of the arbors of the lower rope conveyor assembly and one of the arbors of the upper web conveyor assembly so that the upper disposed web belt and the lower disposed rope conveyor elements cooperatively move the blanks along a linear path, the beater means effecting trim separation downwardly through the rope conveyor elements.

12. The downstacker assembly of claim 11 further comprising:

feed station means for moving blanks from the trim removal conveyor to the vacuum conveyor means.

13. The downstacker assembly of claim 12 wherein the feed station means comprises:

a plurality of spaced apart pairs of belt drive arbors;

a plurality of endless conveyor belts disposed to be drivingly supported by the pairs of belt driven arbors, the conveyor belts having plural holes therethrough at spaced apart locations therealong, the conveyor belts disposed in spaced apart, side by side relationship to each other and more widely separated near the vacuum conveyor means so that blank outs received thereon are moved apart in traveling toward the vacuum conveyor means; and vacuum means for providing a vacuum through the conveyor belt holes at the upper run of the conveyor belts.

14. The downstacker assembly of claim 11 wherein the dunnage holding means comprises:

a laterally extending frame member;

frame support means for supporting and elevating the laterally extending frame member at various heights so that the laterally extending frame member is positionable at substantially the same selected height as that of the stack retrieval means; and gripping means cooperating with and supported by the laterally extending frame member for selectively gripping a dunnage sheet disposed to be supported by the selected material handling device and by already discharged blank stacks so that multiple-tier loads of blank stacks are formable having dunnage sheets between tiers thereof.

15. The downstacker assembly of claim 14 wherein the frame support means comprises:

track means for supporting the laterally extending frame member and for providing vertical travel therealong; and actuator means for elevating and lowering the laterally extending frame member to selected heights along the track means.

16. The downstacker assembly of claim 15 wherein the gripping means comprises:

a laterally extending gripping bar having at least one gripping tab extensive therefrom; and actuator means supported by the laterally extending frame member for selectively moving the gripping bar toward a gripping lip portion of the laterally extending frame member so that a dunnage sheet is retainable between the gripping tab and the gripping lip portion.

17. The downstacker assembly of claim 11 wherein the blank striker means comprises:

first blank striker means positionable at a selected location along the vacuum conveyor means for impacting the rear portions of the blanks; and second blank striker means positioned above the striking surface of the impacting means for impacting the forward portions of the blanks.

18. The downstacker assembly of claim 17 wherein the interrupt means comprises:

sensor means disposed to sense and track the blanks traveling beneath the vacuum conveyor means for detecting blank jams beneath the vacuum conveyor means and for interrupting the passing of blanks to the downstacker assembly when a jam is detected.

* * * * *

UNITED STATES PATENT AND TRADEMARK OFFICE

CERTIFICATE OF CORRECTION

PATENT NO. : 4,900,297

DATED : February 13, 1990

INVENTOR(S) : Terry Frost, Terry B. Smith and Jennings A. Jones

It is certified that error appears in the above-identified patent and that said Letters Patent is hereby corrected as shown below:

Column 1, line 2 of the title, delete the words "CROSS REFERENCE"; and

Column 1, line 3 of the title, before "TO RELATED APPLICATION" insert --CROSS REFERENCE--.

Signed and Sealed this

Twenty-sixth Day of March, 1991

*Attest:*

*Attesting Officer*

HARRY F. MANBECK, JR.

*Commissioner of Patents and Trademarks*